US005732313A

United States Patent [19]

Kawada et al.

[11] Patent Number: 5,732,313

[45] Date of Patent: Mar. 24, 1998

[54] CHARGE APPARATUS AND IMAGE FORMING APPARATUS

[75] Inventors: Masaya Kawada, Nara; Toshiyuki Ehara, Yokohama; Tetsuya Karaki, Kawasaki, all of Japan

[73] Assignee: Canon Kabushiki Kaisha, Tokyo, Japan

[21] Appl. No.: 681,954

[22] Filed: Jul. 30, 1996

[30] Foreign Application Priority Data

Jul. 31, 1995 [JP] Japan ..... 7-195382

[51] Int. Cl.[6] ..... G03G 15/02

[52] U.S. Cl. ..... 399/174; 430/902

[58] Field of Search ..... 399/174, 175, 399/148, 267, 277; 430/902, 57, 66, 67, 84; 361/225

[56] References Cited

U.S. PATENT DOCUMENTS

| | | | |
|---|---|---|---|
| 3,643,311 | 2/1972 | Knechtel et al. | 399/267 X |
| 4,174,903 | 11/1979 | Snelling | 399/148 |
| 4,675,265 | 6/1987 | Kazama et al. | 430/67 |
| 5,666,192 | 9/1997 | Mashino et al. | 399/174 |

FOREIGN PATENT DOCUMENTS

| | | |
|---|---|---|
| 54-83746 | 7/1979 | Japan . |
| 57-11556 | 1/1982 | Japan . |
| 57-158650 | 9/1982 | Japan . |
| 59-111179 | 6/1984 | Japan . |
| 59-133569 | 7/1984 | Japan . |
| 60-67951 | 4/1985 | Japan . |
| 60-95551 | 5/1985 | Japan . |
| 60-168156 | 8/1985 | Japan . |
| 60-35059 | 8/1985 | Japan . |
| 60-178457 | 9/1985 | Japan . |
| 60-225854 | 11/1985 | Japan . |
| 61-100780 | 5/1986 | Japan . |
| 61-231561 | 10/1986 | Japan . |
| 62-168161 | 7/1987 | Japan . |
| 62-278577 | 12/1987 | Japan . |
| 63-208878 | 8/1988 | Japan . |
| 64-34205 | 3/1989 | Japan . |
| 1-34205[Y] | 10/1989 | Japan . |
| 2-106761 | 4/1990 | Japan . |
| 2-38956[B] | 9/1990 | Japan . |

*Primary Examiner*—Joan H. Pendegrass

*Attorney, Agent, or Firm*—Fitzpatrick, Cella, Harper & Scinto

[57] ABSTRACT

The present invention provides a charge apparatus comprising a charge member to which voltage is applied for charging a member to be charged, the charge member having a bearing member for bearing a magnetic particle layer contacted with the member to be charged. The bearing member includes therein a plurality of magnetic poles disposed in a circumferential direction thereof, and the magnetic poles are arranged in a spiral fashion.

9 Claims, 18 Drawing Sheets

FIG. 14

| | PREVENTION LAYER OF ELECTRIC CHARGE POUR-IN | PHOTOCONDUCTIVE LAYER | SURFACE LAYER |
|---|---|---|---|
| GAS KINDS AND FLOW AMOUNT | | | |
| $SiH_4$ [SCCM] | 100 | 200 | 10 |
| $H_2$ [SCCM] | 300 | 800 | |
| $B_2H_6$ [ppm] (RELATIVE TO $SiH_4$) | 2000 | 2 | |
| NO [SCCM] | 50 | | |
| $CH_4$ [SCCM] | | | 500 |
| SUPPORT MEMBER TEMP. [°C] | 290 | 290 | 290 |
| INNER PRESSURE [Torr] | 0.5 | 0.5 | 0.5 |
| POWER [W] | 500 | 800 | 300 |
| FILM THICKNESS [μm] | 3 | 30 | 0.5 |

FIG. 15

| INITIAL | | CHARGE MEMBER | | | | | | | |
|---|---|---|---|---|---|---|---|---|---|
| | | A | B | C | D | E | F | G | H |
| PHOTO-SENSITIVE MEMBER | a | × | △ | × | △ | △ | × | △ | △ |
| | b | × | ○ | × | ○ | ○ | × | ○ | ○ |
| | c | × | ○ | × | ○ | ○ | × | ○ | ○ |
| | d | × | ○ | × | ○ | ○ | × | ○ | ○ |
| | e | × | ○ | × | △ | △ | × | △ | △ |
| | f | × | △ | × | △ | △ | × | △ | △ |

| AFTER USAGE | | CHARGE MEMBER | | | | | | | |
|---|---|---|---|---|---|---|---|---|---|
| | | A | B | C | D | E | F | G | H |
| PHOTO-SENSITIVE MEMBER | a | × | × | × | △ | △ | × | × | × |
| | b | × | × | × | ○ | ○ | × | △ | ○-△ |
| | c | × | × | × | ○ | ○ | × | △ | ○-△ |
| | d | × | × | × | ○ | ○ | × | △ | ○-△ |
| | e | × | × | × | △ | △ | × | × | △ |
| | f | × | × | × | △-× | × | × | × | × |

FIG. 16

| | PREVENTION LAYER OF ELECTRIC CHARGE POUR-IN | PHOTOCONDUCTIVE LAYER | INTERMEDIATE LAYER | SURFACE LAYER |
|---|---|---|---|---|
| GAS KINDS AND FLOW AMOUNT | | | | |
| $SiH_4$ [SCCM] | 150 | 200 | 100 | 10 |
| $H_2$ [SCCM] | 500 | 800 | | |
| $PH_3$ [ppm] (RELATIVE TO $SiH_4$) | 1000 | | | |
| $B_2H_6$ [ppm] (RELATIVE TO $SiH_4$) | | 0.5 | 500 | 500 |
| $CH_4$ [SCCM] | 20 | | 300 | |
| SUPPORT MEMBER TEMP. [°C] | 250 | 250 | 250 | 250 |
| INNER PRESSURE [Torr] | 0.3 | 0.3 | 0.2 | 0.1 |
| POWER [W] | 300 | 600 | 300 | 200 |
| FILM THICKNESS [μm] | 2 | 30 | 0.1 | 0.5 |

| INITIAL | | CHARGE MEMBER | | | | | | | |
|---|---|---|---|---|---|---|---|---|---|
| | | A | B | C | D | E | F | G | H |
| PHOTO-SENSITIVE MEMBER | EMBODI-MENT 4 | ○ | ○ | × | ○ | ○ | × | ○ | ○ |
| | EMBODI-MENT 5 | ○ | ○ | × | ○ | ○ | × | △ | ○ |
| | COMPARISON SAMPLE 1 | △ | △ | × | △ | △ | × | △ | △ |

| AFTER USAGE | | CHARGE MEMBER | | | | | | | |
|---|---|---|---|---|---|---|---|---|---|
| | | A | B | C | D | E | F | G | H |
| PHOTO-SENSITIVE MEMBER | EMBODI-MENT 4 | × | × | × | ○ | ○ | × | ○-△ | ○-△ |
| | EMBODI-MENT 5 | × | × | × | ○ | ○ | × | △-× | △ |
| | COMPARISON SAMPLE 1 | × | × | × | × | × | × | × | × |

FIG. 19

| | PREVENTION LAYER OF ELECTRIC CHARGE POUR-IN | PHOTOCONDUCTIVE LAYER | SURFACE LAYER |
|---|---|---|---|
| GAS KINDS AND FLOW AMOUNT | | | |
| $SiH_4$ [SCCM] | 150 | 200 | 200→10→10 |
| $SIF_4$ [SCCM] | 5 | 3 | 10 |
| $H_2$ [SCCM] | 500 | 800 | |
| $B_2H_6$ [ppm] (RELATIVE TO $SiH_4$) | 1500 | 3 | |
| NO [SCCM] | 10 | | |
| $CH_4$ [SCCM] | 5 | | 0→500→500 |
| SUPPORT MEMBER TEMP. [°C] | 300 | 300 | 300 |
| INNER PRESSURE [mTorr] | 30 | 10 | 20 |
| POWER [W] | 200 | 600 | 100 |
| FILM THICKNESS [μm] | 2 | 30 | 0.5 |

FIG. 20

| | PREVENTION LAYER OF ELECTRIC CHARGE POUR-IN | PHOTOCONDUCTIVE LAYER | SURFACE LAYER |
|---|---|---|---|
| GAS KINDS AND FLOW AMOUNT | | | |
| $SiH_4$ [SCCM] | 300 | 100 | 20 |
| $H_2$ [SCCM] | 500 | 600 | |
| $B_2H_6$ [ppm] (RELATIVE TO $SiH_4$) | 3000 | 5 | |
| NO [SCCM] | 5 | 1 | |
| $NH_3$ [SCCM] | | | 400 |
| SUPPORT MEMBER TEMP. [°C] | 290 | 310 | 250 |
| INNER PRESSURE [mTorr] | 20 | 15 | 10 |
| POWER [W] | 300 | 800 | 100 |
| FILM THICKNESS [μm] | 3 | 25 | 0.3 |

FIG. 21

| | ELECTRIC CHARGE TRANSPORT LAYER | ELECTRIC CHARGE GENERATION LAYER | SURFACE LAYER |
|---|---|---|---|
| GAS KINDS AND FLOW AMOUNT | | | |
| $SiH_4$ [SCCM] | 300 | 100 | 100→10→8 |
| $SIF_4$ [SCCM] | 5 | 5 | 1 |
| $H_2$ [SCCM] | 500 | 500 | |
| $B_2H_6$ [ppm] (RELATIVE TO $SiH_4$) | 10→2 | 2 | |
| NO [SCCM] | 1 | | |
| $CH_4$ [SCCM] | 100→0 | | 0→500→500 |
| SUPPORT MEMBER TEMP. [°C] | 280 | 250 | 250 |
| INNER PRESSURE [mTorr] | 20 | 20 | 20 |
| POWER [W] | 600 | 400 | 100 |
| FILM THICKNESS [μm] | 25 | 3 | 0.5 |

FIG. 22

| | PREVENTION LAYER OF ELECTRIC CHARGE POUR-IN | ELECTRIC CHARGE TRANSPOR-TATION | ELECTRIC CHARGE GENERATION | INTER-MEDIATE LAYER | SURFACE LAYER |
|---|---|---|---|---|---|
| GAS KINDS AND FLOW AMOUNT | | | | | |
| $SiH_4$ [SCCM] | 200 | 300 | 100 | 30 | 30 |
| $H_2$ [SCCM] | 500 | 1000 | 600 | | |
| $B_2H_6$ [ppm] (RELATIVE TO $SiH_4$) | 500 | 5→1 | 1 | 300 | 5 |
| $PH_3$ [ppm] (RELATIVE TO $SiH_4$) | 0.5 | 0.5 | 0.1 | 0.1 | 0.1 |
| $CO_2$ [SCCM] | 20 | 100→0 | 0.1 | 200 | 500 |
| SUPPORT MEMBER TEMP. [°C] | 250 | 250 | 250 | 250 | 250 |
| INNER PRESSURE [mTorr] | 10 | 15 | 15 | 5 | 5 |
| POWER [W] | 100 | 600 | 500 | 200 | 300 |
| FILM THICKNESS [μm] | 3 | 30 | 2 | 0.1 | 0.5 |

CHARGE APPARATUS AND IMAGE FORMING APPARATUS

BACKGROUND OF THE INVENTION

1. Field of the invention

The present invention relates to a charge apparatus and an image forming apparatus in which a member to be charged is charged by applying charge voltage to a magnet brush contacted with the member to be charged.

2. Related Background Art

1. Image Forming Apparatus

As image forming apparatuses, in addition to a conventional copying machines for copying an original image, printers have been used as output means for computers and word processors which have been widely used. Such printers are used not only in offices but also by individuals. In the office use, economization such as low cost and maintenance free is important.

Further, from the viewpoint of ecology, environment protection and saving of energy are also important to the same extent as the economization. As for the environment protection, for example, generation of ozone must be suppressed, and, as for the saving of energy, consumption of sheets should be reduced, for example, by forming images on both surfaces of the sheet or by utilizing regenerated sheets, or power consumption should be reduced.

In a corona charger (as a charge means) mainly used with the conventional image forming apparatus, corona discharge is generated by applying high voltage of about 5 to 10 kV to metal wires having a diameter of about 50 to 100 μm and atmosphere is ionized to charge a counter part. In the discharge process, since the dirt is absorbed to the wires themselves, the wires must be cleaned or exchanged periodically, and, ozone is greatly generated.

As for the saving of energy, in addition to the above, there is a problem regarding the heating of a photosensitive member. Recently, an electrophotographic photosensitive member is so designed that surface hardness thereof is increased to increase the number of copies and to enable long term usage. Thus, corona products are formed by ozone repeatedly generated from the corona discharger, with the result that the surface of the photosensitive member becomes more sensitive to humidity (apt to absorb moisture). This causes drift of charges on the surface of the photosensitive member, thereby generating deterioration of image quality such as image-flow.

In order to prevent such image-flows, there have been proposed a method for removing the moisture from the surface of the photosensitive member by heating the latter (as disclosed in the Japanese Utility Model Publication No. 1-34205 (1989)), and a method for removing the corona products by slidingly contacting, with the surface of the photosensitive member, a brush formed by a magnet roller and a magnetic carrier (as disclosed in the Japanese Patent Publication No. 2-38956 (1990)) or by an elastic roller (as disclosed in the Japanese Patent Application Laid-Open No. 61-100780 (1986)).

Among them, the latter method for contacting the brush or the elastic roller with the surface of the photosensitive member is effective to a photosensitive member formed from very hard amorphous silicone. However, since the apparatus becomes complicated, this method is contrary to compactness and inexpensiveness of the apparatus which are strongly requested in the present day. On the other hand, the former method for always heating the photosensitive member by a heater increases consumption of electric power. Although the capacity of such a heater is not so great (normally, 15 to 80 W), since the heater is normally energized throughout the day including the midnight, a consumption power amount per day becomes 5–15% of that of the entire image forming apparatus.

Incidentally, also in techniques (which is similar to the present invention and) in which a photosensitive member is heated by an external heater, as disclosed in the Japanese Patent Application Laid-Open Nos. 59-111179 (1984) and 62-278577 (1987), improvement in factors for unstabilizing image density due to fluctuation of temperature of a photosensitive member is not considered at all.

Further, the ozone causing the image flow has conventionally been removed by using an ozone removing filter. In this way, it has been requested that the ozone generated during the charging operation is greatly reduced economically. Under these circumstances, it has been required to provide a charge apparatus in which ozone is not or almost not generated, a moisture removing apparatus in which electric power is less consumed, and an image apparatus having such charge apparatus and moisture removing apparatus.

2. Charge Apparatus

In order to solve the above problems, various charge apparatuses have been proposed.

In a charge apparatus of contact charge type as disclosed in the Japanese Patent Application Laid-Open No. 63-208878 (1988), a charge member to which voltage (bias voltage) is applied is urged against a member to be charged (such as a photosensitive member) to charge a surface of such a member to predetermined potential. In comparison with the above-mentioned corona charger which has widely been used as a charge apparatus, this charge apparatus of contact charge type has advantages that, firstly, the bias voltage required to charge the surface of the member to be charged to the predetermined potential can be reduced, and, secondly, the ozone is not or almost not generated during the charging operation, so that the ozone removing filter can be omitted and accordingly an exhaust system of the apparatus can be simplified to achieve maintenance-free. Thirdly, there is no need to remove moisture by driving the heater through a day in order to prevent the image flow caused due to the reduction in resistance of the surface of an image bearing member such as a photosensitive member (member to be charged) to which the ozone and ozone products were adhered (to make the surface more sensitive to moisture), and, thus, the consumption of power can be greatly reduced.

Accordingly, such a charge apparatus of contact charge type has been watched and practically used as a means for charging an image bearing member (for example, photosensitive member or dielectric member) or other member to be charged in an electrophotographic or electrostatic image forming apparatus such as a laser beam printer.

As the charge apparatuses of contact charge type, a charge means in which a fixed (plate-shaped or sheet-shaped) charge member is urged against a member to be charged and bias voltage is applied to the charge member to charge the member to be charged is well-known. FIG. 8 shows an example of such a charge apparatus using a blade.

In FIG. 8, a drum-shaped electrophotographic photosensitive member (referred to merely as "photosensitive drum" hereinafter) 801 is rotated in a direction (clockwise direction) shown by the arrow A at a predetermined peripheral speed (process speed). A contact charge member 802 comprises an electrode 802-1 and a resistance layer 802-2 formed on the charge surface of the electrode. The electrode 802-1 is normally formed from metallic material such as aluminium, aluminium alloy, brass, copper, iron or stainless steel, or insulation material such as ceramic on which metal layer is coated or conductive paint is painted.

The resistance layer 802-2 is formed by dispersing conductive filler such as titanium oxide, carbon powder or metal powder into resin such as polypropylene or polyethylene or elastomer such as silicone rubber or urethane rubber. The resistance layer 802-2 has a resistance value of $1\times10^3$ to $1\times10^{12}$ Ω.cm (when subjected to voltage of 0.25 to 1 kV) measured by an MΩ tester manufactured by HIOKI Co. Ltd.

A power source 803 serves to apply the voltage to the contact charge member 802. Charge voltage ($V_{ac}+V_{dc}$) obtained by overlapping vibration voltage $V_{ac}$ having peak-to-peak voltage $V_{pp}$ greater than charge start voltage by twice or more with DC voltage $V_{dc}$ is applied to the electrode 802-1 from the power source 803, with the result that a surface (outer peripheral surface) of the rotating photosensitive member 801 is uniformly charged.

Further, by scanning the photosensitive member 801 by a laser beam (exposure light) 805 intensity of which is modulated in response to an image signal, an electrostatic latent image is formed on the photosensitive drum. The electrostatic latent image is visualized with developing agent (toner) by a developing sleeve 806 as a toner image which is in turn transferred onto a transfer material 807 by means of a transfer roller 808. The transfer material 807 to which the toner image was transferred is sent to a fixing device (not shown), where the toner image is fixed to the transfer material. Then, the transfer material is discharged out of a body (not shown) of the image forming apparatus. On the other hand, after the transferring operation, residual toner remaining on the photosensitive drum 801 is removed by a cleaning blade 809 for preparation for next image formation.

However, according to the above-mentioned contact charge member 802, since the contact charge member 802 is directly and frictionally contacted with the surface of the photosensitive drum 801 to generate high friction, the contact charge member 802 is greatly worn for a long term use. Thus, the contact charge member must be exchanged to new one periodically. Since a photosensitive member made of amorphous silicon has semipermanent service life, the replacement of the contact charge member 802 disturbs the maintenance-free. An improvement of the contact charge member has strongly been requested.

To achieve such improvement, as disclosed in the Japanese Patent Application Laid-Open No. 59-133569 (1984), there has been proposed a technique in which a magnet brush type contact charge member consisting of a magnetic member and magnetic powder (or particles) is contacted with the photosensitive member to charge the latter.

FIGS. 9A and 9B show such a technique. A drum-shaped photosensitive member 901 is rotated in a direction (clockwise direction) shown by the arrow A at a predetermined peripheral speed (process speed). A contact charge member 902 comprises a multi-pole magnetic member 902-2 and a magnet brush layer 902-1 consisting of magnetic powder born on a charge surface of the magnetic member.

The multi-pole magnetic member 902-2 is normally formed from magnetic material such as ferrite magnet or rubber magnet and is formed as a cylindrical magnet roller. The magnet brush layer 902-1 is generally formed from well-known magnetic toner material such as magnetic iron oxide (ferrite) powder or magnetite powder. It is desirable that a resistance value of such a contact charge member 902 is appropriately selected in accordance with application environment, high charging efficiency and/or a voltage-resistance feature of the surface layer of the photosensitive member.

A distance between the photosensitive member 901 and the multi-pole magnetic member 802-2 is stably set to a constant distance in order to stably control a contact width (referred to as "charge nip" hereinafter) between the magnet brush layer 902-1 and the surface of the photosensitive member 901. The distance is preferably 50 to 2000 μm, and more preferably 100 to 1000 μm. A power source 903 serves to apply voltage to the contact charge member 902. By applying DC voltage $V_{dc}$ to the multi-pole magnetic member 902-2 and magnet brush layer 902-1 from the power source 903, the outer peripheral surface of the photosensitive member 901 is uniformly charged.

Further, by scanning the photosensitive member 801 by a laser beam (exposure light) 905 intensity of which is modulated in response to an image signal, an electrostatic latent image is formed on the photosensitive drum 901. The electrostatic latent image is visualized with developing agent (toner) by a developing sleeve 906 as a toner image which is in turn transferred onto a transfer material 907 by means of a transfer roller 908. The transfer material 907 to which the toner image was transferred is sent to a fixing device (not shown), where the toner image is fixed to the transfer material. Then, the transfer material is discharged out of a body (not shown) of the image forming apparatus. On the other hand, after the transferring operation, residual toner remaining on the photosensitive drum 901 is removed by a cleaning blade 909 for preparation for next image formation.

According to the above-mentioned contact charge member 902, a contact feature and frictional feature between the photosensitive member 901 and the contact charge member 902 can be improved, and mechanical wear causing deterioration can be greatly reduced.

3. Photosensitive Member

[Organic Photo-conductive Body (OPC)]

Various photo-conductive materials for use with the electrophotographic photosensitive member have recently been progressed. In particular, a photosensitive body obtained by laminating a charge generating layer and a charge transferring layer has already been used practically with an image forming apparatus such as a copying machine and a laser beam printer. However, such photosensitive body has a great disadvantage that a service life thereof (endurance feature) is relatively short. The endurance feature is generally divided into an electrophotographic endurance feature such as sensitivity, residual potential, charge ability, image fog and the like, and a mechanical endurance feature such as wear and/or scratch on the photosensitive member due to sliding contact (between the photosensitive member and the charge member). These features are great factors for determining the service life of the photosensitive body.

Among them, regarding the electrophotographic endurance feature (particularly, image fog), it is known that such feature is worsened by the deterioration of charge transferring substance inclined in the surface layer of the photosensitive member caused by active substances such as ozone and NOx generated from a corona charger. Regarding the mechanical endurance feature, it is known that such feature is worsened by slidingly contact between the photosensitive layer and a sheet, a cleaning member such as blade/roller and the toner.

In order to enhance the electrophotographic endurance feature, it is important that a charge transferring substance which is hard to be deteriorated by the active substances such as ozone and NOx, and it is known that a charge transferring substance having high oxidizing potential is selected. In order to enhance the mechanical endurance feature, it is important that surface lubricity is increased to minimize the wear caused by the sliding contact between the photosensitive layer and the sheet and/or cleaning member and that surface mold releasing ability is increased to prevent the filming of toner on the photosensitive layer, and it is known that lubricant such as fluororesin powder, graphite fluoride powder or polyolefin resin powder is included in the surface layer. However, if the wear is greatly reduced, moisture absorbing substances generated by the active substances such as ozone and NOx are accumulated on the surface of the photosensitive member, with the result that surface resistance is decreased to shift the surface charges laterally, thereby causing the image flow.

[Amorphous Silicone Photosensitive Body (a-Si)]

In electrophotography, it is required that photoconductive material forming a photosensitive layer on the photosensitive member has high sensitivity, high SN ratio (bright current ($I_p$)/dark current ($I_d$)), absorption spectrum accommodating to spectrum feature of an electromagnetic wave illuminated onto the photosensitive member, quick photoresponse, and a desired dark resistance value. Particularly, in case of a photosensitive member incorporated into an image forming apparatus used as an office machine in an office, the above-mentioned harmlessness in use is very important.

A photo conductive material having the above excellent feature is amorphous silicone hydride (referred to as "a-Si:H" hereinafter). For example, the Japanese Patent Publication No. 60-35059 (1985) discloses the fact that such photo-conductive material is used as a photosensitive body of an image forming apparatus.

In such a photosensitive body of the image forming apparatus, a conductive support member is heated to 50° to 400° C., and a photo-conductive layer made of a-Si is formed on the conductive support member by a film forming method such as vacuum deposition, spattering, ion-plating, thermal CVD method, optical CVD method or plasma CVD method. Among them, the plasma CVD method in which an a-Si deposit film is formed on a support member by decomposing material gas by glow discharge of direct current, high-frequency wave or micro wave is preferable and is put to practical use.

Further, as disclosed in the Japanese Patent Application Laid-Open No. 54-83746 (1979), a photosensitive body of an image forming apparatus comprised of a conductive support member and photo-conductive layer made of a-Si including halogen atoms as component (referred to as "a-Si:X" hereinafter) has been proposed. In this technique, by including the halogen atoms of 1 to 40 atom % in the a-Si, it is possible to obtain electrical and optical feature suitable as a photo-conductive layer of the photosensitive body of the image forming apparatus.

Further, the Japanese Patent Application Laid-Open No. 57-11556 (1982) discloses a technique in which a surface shield layer made of non-photo-conductive amorphous material including silicon atoms and carbon atoms is formed on a photo-conductive layer made of amorphous material mainly including silicon atoms in order to improve electrical, optical and photo-conductive features (of a photo-conductive member having a photo-conductive layer formed from an a-Si deposit film) such as a dark resistance value, photo-sensitivity and photo-response, an application environmental feature and long term stability. Further, the Japanese Patent Application Laid-Open No. 60-67951 (1985) discloses a technique in which a light permeable insulation overcoat layer including amorphous silicon, carbon, oxygen and fluorine is formed on a photosensitive member, and the Japanese Laid-Open No. 62-168161 (1987) discloses a technique in which non-crystal material including silicon atoms, carbon atoms and hydrogen atoms of 41 to 70 atom % is used as a surface layer.

Further, the Japanese Patent Application Laid-Open No. 57-158650 (1982) discloses a technique in which an a-Si:H including hydrogen atoms of 10 to 40 atom % and having absorption coefficient ratio (between absorption peaks of 2100 $cm^{-1}$ and 2000 $cm^{-1}$ of infrared ray absorption spectrum) of 0.2 to 1.7 is used as a photo-conductive layer, thereby obtaining a photosensitive member (of an image forming apparatus) having high sensitivity and high resistance.

On the other hand, the Japanese Patent Application Laid-Open No. 60-95551 (1985) discloses a technique in which, in order to improve image quality obtained by a photosensitive member formed from amorphous silicon, by effecting image forming processes such as charging, exposure development and transferring while maintaining a temperature near a surface of the photosensitive member to 30° to 40° C., reduction in surface resistance due to absorption of moisture to the surface of the photosensitive member and high humidity image flow therefor can be prevented.

By using the above-mentioned techniques, the electric, optical and photo-conductive features and application environmental feature of the photosensitive member of the image forming apparatus can be improved, thereby improving the image quality.

4. Environment Protection Heater

In order to prevent or eliminate the above-mentioned image flow due to high humidity of the photosensitive member, it is well known to provide a heat source within the photosensitive member. Most generally, a surface-shaped or rod-shaped electric heater is disposed within a cylindrical photosensitive member. However, when the charge apparatus using the above-mentioned brush of magnetic particles (to which the voltage is applied) is used as the charge means for the photosensitive member, the following problems arise.

Particularly when the rotational speed of the photosensitive member 901 is fast or when the difference in potential between the charged portion and the non-charged portion is great, the endurance (service life) of the contact charge member 902 becomes worsened. Carrier (referred to as "charge carrier" hereinafter) such as magnetic powder forming the magnet brush layer 902-1 is shifted toward the surface of the photosensitive member during the charging process and during the rotation of the photosensitive member 901, with the result that the charging efficiency is worsened to generate the difference in density of the developed image along the rotational direction of the photosensitive member 901. Particularly, in the image forming apparatus using the photosensitive member (such as amorphous silicon photosensitive member) rotated at a high speed and having a very long service life, the image quality is worsened by reduction of the charge carrier of the contact charge member 902, with the result that the maintenance must be performed and the contact charge member 902 must be exchanged. This increases the service cost and disturbs the maintenance-free.

Further, stripes (referred to as "spotted stripes" hereinafter) may be generated. It is considered that the spotted stripes are generated as follows. That is to say, the charge carriers are shifted to the photosensitive member 901 by a mechanical force such as a friction force due to the rotation of the photosensitive member 901 and an electric absorbing force generated by an electric field caused by the potential difference between the charge portion and the non-charged portion on the surface of the photosensitive member in opposition to a magnetic absorbing force between the multi-pole magnetic member 902-2 and the charge carriers, and some of charge carriers are magnetically absorbed to the developing sleeve 906 of the developing device. As the number of copies obtained by the image forming apparatus is increased, an amount of the carriers absorbed to the developing sleeve 906 is increased, with the result that the absorbed carriers disturb the transferring of the toner to the surface of the photosensitive member 901, thereby generating the spotted stripes.

The Japanese Patent Application Laid-Open No. 59-133569 (1984) discloses a technique in which a blade is disposed at a downstream side of a charger in a rotational direction of a photosensitive member to catch the charge carriers. However, this technique makes the entire apparatus bulky and expensive and disturbs the maintenance-free.

SUMMARY OF THE INVENTION

An object of the present invention is to provide a charge apparatus and an image forming apparatus which can prevent magnetic particles of a charge member from adhering to a member to be charged.

Another object of the present invention is to provide a charge apparatus and an image forming apparatus which can prevent a poor image due to adhesion of magnetic particles to a member to be charged (image bearing member).

A further object of the present invention is to provide a charge apparatus and an image forming apparatus which prevent adhesion of magnetic particles to a member to be charged, without making the apparatus bulky.

The other objects and features of the present invention will be apparent from the following description referring to the accompanying drawings.

BRIEF DESCRIPTION OF THE DRAWINGS

FIG. 14 is a view showing manufacturing conditions of the photosensitive member of the first embodiment;

FIG. 15 is a view showing relations between combination of the photosensitive member/charge contact member of the first embodiment and image quality before (initial) and after usage;

FIG. 16 is a view showing manufacturing conditions of the photosensitive member of the second embodiment;

FIG. 19 is a view showing manufacturing conditions of a photosensitive member of a sixth embodiment of the present invention;

FIG. 20 is a view showing manufacturing conditions of a photosensitive member of a seventh embodiment of the present invention;

FIG. 21 is a view showing manufacturing conditions of a photosensitive member of an eighth embodiment of the present invention; and FIG. 22 is a view showing manufacturing conditions of a photosensitive member of a ninth embodiment of the present invention.

DETAILED DESCRIPTION OF PREFERRED EMBODIMENTS

The present invention will now be explained in connection with embodiments thereof with reference to the accompanying drawings.

[Charge Member]

Figure 1A:
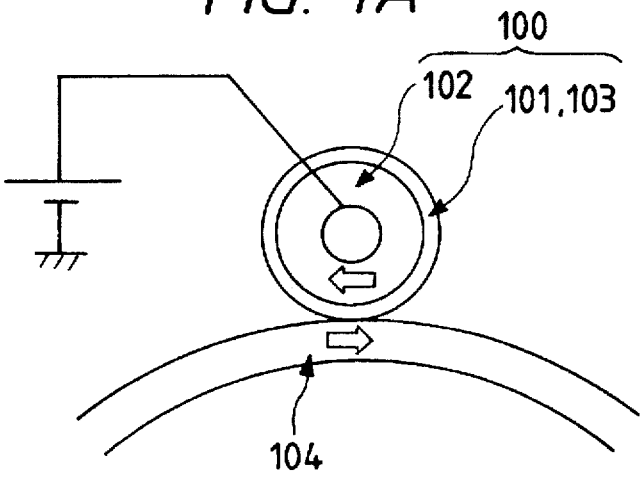
FIG. 1A is a partial side view of a contact charge member and a photosensitive member according to a first embodiment of the present invention.
Figure 1B:
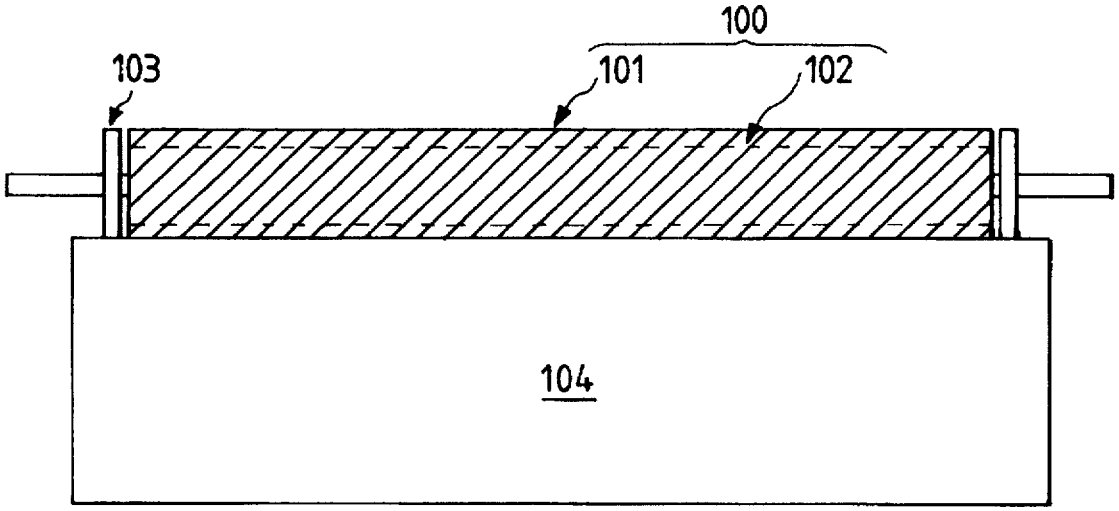
FIG. 1B is a front view of the contact charge member and the photosensitive member of FIG. 1A.

In FIGS. 1A and 1B, the reference numeral 100 denotes a contact charge member; 101 denotes a magnet brush layer consisting of charge carriers (magnetic powder particles) forming the contact charge member 100; 102 denotes a multi-pole magnetic member of the contact charge member 100; and 103 denotes a spacer for regulating a gap between the multi-pole magnetic member 102 and a photosensitive member (as a member to be charged).

The multi-pole magnetic member 102 is normally made of metal such as ferrite magnet or magnetic material (permitting formation a multi-pole structure) such as plastic magnet, and, as will be described later, has a spiral structure.

Magnetic flux density thereof is varied with various factors such as a process speed of an image forming apparatus, an electric field generated due to potential difference between applied voltage and potential on a charged portion, and dielectric constant and surface feature of the photosensitive member 104. The magnetic flux density measured at a magnetic pole position spaced apart from a surface of the multi-pole magnetic member 102 by 1 mm is preferably 500 G (Gauss) or more, and more preferably 1000 G or more.

It is desirable that a minimum gap between the photosensitive member 104 and the multi-pole magnetic member 102 is stably set to a constant value by means of a roller or the spacer 103 in order to stably control a charge nip (contact width) of the magnet brush layer 101. The gap or distance is preferably 50 to 2000 μm, and more preferably 100 to 1000 μm. A mechanism such as a blade for adjusting the nip may be provided.

The magnet brush layer 101 (consisting of the charge carriers) of the contact charge member 100 is generally formed from magnetic powder such as ferrite or magnesium, or known carriers for magnetic toner. A diameter of the magnetic powder particle is generally 1 to 100 μm and is preferably 50 μm or less. Further, various carriers having different diameters within the above range may be mixed with each other to improve the fluidity.

The resistance of the magnet brush layer 101 is preferably $1\times10^3$ to $1\times10^{12}$ Ω.cm and more preferably $1\times10^4$ to $1\times10^9$ Ω.cm in order to maintain the good charging efficiency and to prevent the reduction in potential of the charge member in a longitudinal direction thereof due to leak and minute defect in the surface of the photosensitive member. The resistance value (when subjected to voltage of 0.25 to 1 kV) is measured by an MΩ tester manufactured by HIOKI Co. Ltd.

Although the photosensitive member 104 may be a conventional one, a new photosensitive member which will be described later is used on demand.

By arranging the magnetic poles of the multi-pole magnetic member 102 of the contact charge member 100 using the magnet brush layer 101 in the spiral form, the charge carriers shifted toward the photosensitive member 104 in the charge nip by the electrostatic absorbing forge and the frictional forge is caught by the magnetic pole disposed at a downstream side in a rotational direction of the photosensitive member, thereby preventing the reduction of the charge carriers.

Further, for example, as shown by the arrow in FIG. 1A, by rotating the contact charge member 100, the chance that the charge carriers are caught by the magnetic poles of the multi-pole magnetic member 102 in the charge nip is increased, thereby increasing the carrier catching efficiency.

Non-charged portions of the photosensitive member 104 are disposed adjacent to ends of the contact charge member 100. Thus, due to the electrostatic absorbing forge generated by the great difference in potential between the contact charge member 100 and the photosensitive member and due to the influence of the fact that the charge carriers are pushed outwardly of the contact charge member 100, the reduction ratio of the charge carriers was great. However, by providing a mechanism for conveying the charge carriers toward a central portion of the charge member in a longitudinal direction thereof, the reduction of the charge carriers at the ends of the contact charge member 100 can be prevented effectively.

By this action, even when the image forming conditions such as the process speed, the setting of charge potential of the contact charge member 100 and the like are changed, the contact charge system used in a wide range can be provided.

[Photosensitive Member]

As one means for solving the above problem, the inventors found that the good image stability can be achieved for a long time by using a photosensitive member having small temperature dependency and excellent surface endurance.

[Organic Photo-conductive Body (OPC)]

Now, an OPC photosensitive body in one form of a photosensitive member used in the present invention will be explained. FIG. 11E is a schematic illustration showing a layer structure of the photosensitive member of the image forming apparatus used in the present invention.

In the OPC photosensitive body 1100 shown in FIG. 11E, a photosensitive layer 1102 is formed on a cylindrical support (referred to merely as "support" hereinafter) 1101 as a photosensitive member. The photosensitive layer 1102 has a photo-conductive layer (charge generating layer 1106 and charge transferring layer 1107) 1103. If necessary, a protection layer or surface layer 1104 may be provided, and an intermediate layer may be provided between the support 1101 and the charge generating layer 1106.

Among the surface layer 1104, photo-conductive layer 1103 and intermediate layer of the OPC photosensitive body used in the present invention, particularly, it is preferable that the surface layer 1104 permits the charge input from the contact charge member 100 efficiently and holds the charges effectively. The inventors found that a material obtained by mixing high melting point polyester resin with curable resin (and, in the surface layer 1104, by dispersing metal oxides such as $SnO_2$ into the mixture of high melting point polyester resin and curable resin) is desirable in the point that the features of the resin components can be relatively achieved to satisfy the above conditions.

Now, resin components for forming the surface layer 1104 and the photo-conductive layer 1102 (charge transferring layer 1107 and charge generating layer 1106) of the electrophotographic photosensitive body according to the present invention will be explained.

Polyester is bonded polymer including acid component and alcohol component and is polymer obtained by condensation of dicarboxylic acid and glycol or by condensation of compound having hydroxyl group and carboxyl group of hydroxy benzoic acid. The acid component may be aromatic dicarboxylic acid such as terephthalic acid, isophthalic acid or naphthalene dicarboxylic acid, or aliphatic dicarboxylic acid such as succinic acid, adipic acid or sabatine acid, or alicyclic dicarboxylic acid such as hexahydroterephthalic acid, or oxycarboxylic acid such as hydroxy-ethoxy benzoic acid. The glycol component may be ethylene glycol, trimethylene glycol, tetramethylene glycol, hexamethylene glycol, cyclohexane dimethylol, polyethylene glycol or polypropylene glycol.

Incidentally, within a range that the polyester resin is substantially linear, multifunctional compound of pentaerythritol, rolimethylol propane, pyromerit acid and their esters forming derivative may be copolymerized.

As the above-mentioned polyester resin, high melting point polyester resin is used.

The high melting point polyester resin has limiting viscosity of 0.4 dl/g or more, preferably 0.5 dl/g or more, and more preferably 0.65 dl/g or more measured in orthochlorophenol having a temperature of 36° C. Preferably, the high melting point polyester resin is resin of polyalkylene terephthalate system. The polyalkylene terephthalate system resin mainly includes terephthalic acid as acid component and alkylene glycol as glycol component.

More specifically, polyalkylene terephthalate system resin may be polyethylene terephthalate (PET) mainly including terephthalic acid component and ethylene glycol component, polybutylene terephthalate (PBT) mainly including terephthalic acid component and 1,4-tetramethylene glycol (1,4-butylene glycol) component, and polycyclohexyl-dimethylene terephthalate (PCT) mainly including terephthalic acid component and cyclohexane dimethylol. Other preferable high molecular weight polyester resin is polyalkylene naphthalate system resin. The polyalkylene naphthalate system resin mainly includes naphthalene dicarboxylic acid as acid component and alkylene glycol as glycol component, and, more particularly, may be polyethylene naphthalate (PEN) mainly including naphthalene dicarboxylic acid component and ethylene glycol component.

The high melting point polyester resin has a melting point of preferably 160° C. or more and more preferably 200° C. or more. Other than the polyester resin, acrylic resin may be used. Further, as binder, 2-functional acryl, 6-functional acryl or phosphagen can be used.

Such resins have relatively high crystallinity, and uniform and compact entanglement between curable resin chains and high melting point polymer chains, thereby providing a surface layer having high durability. In case of low melting point polyester resins, since crystallinity is low, there are strong and weak entanglement portions between curable resin chains and low melting point polyester chains, thereby decreasing durability.

Charge holding material such as $SnO_2$ is dispersed in the surface layer 1104. It is preferable that the resistance value and charging efficiency are controlled by appropriately selecting the dispersed amount in accordance with application conditions.

[Amorphous Silicon System Photosensitive Body (a-Si)]

Now, an amorphous silicon photosensitive body suitable to be used as the photosensitive member of the present invention will be explained.

As a result of investigation for checking a relation between local condition distribution of the band gap and temperature dependency/light memory of charging ability while checking movement of carriers of the photo-conductive layer of an amorphous silicon photosensitive body, it was found that the above-mentioned object can be achieved by controlling local condition density of specific energy range to bring within a predetermined range in at least a portion of the photo-conductive layer on which the light is incident. That is, to say, among photosensitive bodies having a photo-conductive layer formed from non-crystal material based on silicon atoms and including hydrogen atoms and/or halogen atoms, it was found that a photosensitive body designed to specify the layer structure not only has a practically excellent feature but also is superior to conventional photosensitive bodies (particularly, has an excellent feature for the photosensitive member of the image forming apparatus).

The photosensitive member of the image forming apparatus according to the present invention comprises a conductive support, and a photo-conductive layer made of non-crystal material based on silicon atoms. The photo-conductive layer includes hydrogen of 10 to 30 atom % and has feature energy of exponential function tail (arback tail) of light absorption spectrum of 50 to 60 meV and local condition density of $1\times10^{14}$ to $1\times10^{16}$ $cm^{-3}$.

The photosensitive member of the image forming apparatus designed to have the above features can solve all of the above-mentioned problems and provides excellent electrical, optical and photo-conductive features, excellent image quality, excellent durability and excellent application environmental feature.

In general, in the band gap of a-Si:H, there are tail level due to structural distortion of S—Si bonding and deep level due to structural defect such as non bonded hands of Si (dangling bond). It is known that these levels act to catch electrons and positive holes and act as re-bonding centers and become factors for reducing the features of elements.

As methods for measuring a condition of local level in the band gap, there have been proposed a deep level spectroscopic method, an isothermal capacity excess spectroscopic method, a photothermal deflection spectroscopic method and a constant photocurrent method (CPM). Among them, the constant photocurrent method is useful as a method for easily measuring light absorption spectrum of sub gap due to local level of a-Si:H.

As a result of investigation for checking a relation between the feature energy (referred to as "Eu" hereinafter) of the exponential function tail sought from the light absorption spectrum measured by the CPM and local condition density (referred to as "DOS" hereinafter) and the features of the photosensitive body under various conditions, the inventors found that the Eu and DOS have a close relation to the temperature characteristic and light memory of the a-Si photosensitive body, and obtained the present invention.

One of factors for decreasing the charging ability upon heating of the photosensitive body by means of a drum heater is the fact that thermally driven carriers are moved along the surface while repeating the catch and release of the carriers with respect to the local level of the band tail and the deep local level in the band gap due to the electric field, thereby cancelling the surface charges. In this case, although the thermally driven carriers reached to the surface while being passed through the chargers does not contribute to the reduction of the charging ability, since the thermally driven carriers caught in the deep level reach the surface after they have ben passed through the charger to thereby cancel the surface charges, such carriers are observed as temperature characteristic. Further, the thermally driven carriers thermally driven after passed through the charger also cancel the surface charges, thereby decreasing the charging ability. Accordingly, in order to improve the temperature characteristic, it is necessary to suppress the formation of the thermally driven carriers and improve the movability of the thermally driven carriers.

Further, the light memory is caused by the fact that light carriers generated by blank exposure or image exposure are caught by the deep level in the band gap, thereby remaining the light carriers n the photo-conductive layer. That is to say, among the light carriers generated in a certain copying process, the light carriers remaining in the photo-conductive layer are swept out by the electric field (produced due to surface charges) in the next charging operation or thereafter, with the result that the potential of the portion on which the light is illuminated becomes smaller than those of the other portions, thereby causing uneven density on the image. Accordingly, the movability of the light carriers must be improved so that the light carriers can be shifted in each copying process without remaining in the photo-conductive layer.

Therefore, as is in the present invention, by controlling the Eu and DOS of specific energy range, since the formation of the thermally driven carriers can be suppressed and the amount of the thermally driven carriers and/or light carriers caught in the local level can be reduced, the movability of the carriers (referred to as "charge carriers" hereinafter) can be improved. As a result, since the temperature characteristic of the photosensitive body in the application temperature range is remarkably improved and at the same time the formation of the light carriers can be suppressed, the stability of the photosensitive body in the application environment can be improved, sharp half tone can be obtained, and an image having high resolving power and high image quality can be obtained stably.

Next, the photo-conductive-layer according to the present invention will be explained with reference to FIGS. 11A to 11E.

Figure 11A:
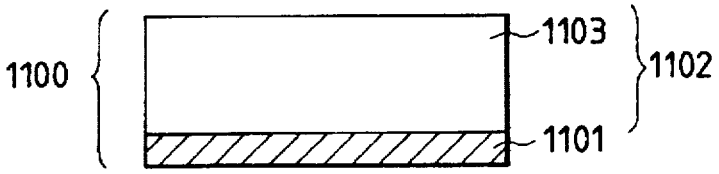
FIGS. 11A to 11E are partial sectional views showing various photosensitive bodies.

A photosensitive body 1100 shown in FIG. 11A comprises a conductive support member (support) 1101 for the photosensitive member, and a photosensitive layer 1102 formed on the support. The photosensitive layer 1102 is constituted by a photo-conductive layer 1103 made of a-Si:H, X and having photo-conductivity.

Figure 11B:
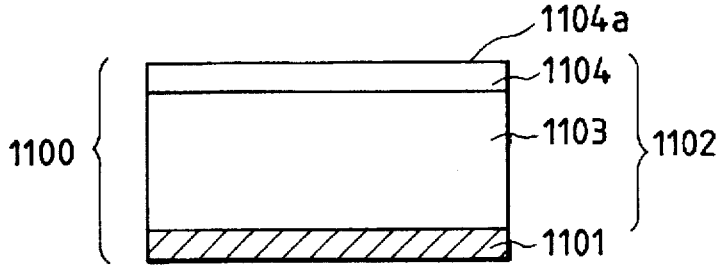

FIG. 11B is a schematic illustration for explaining another layer structure of the photosensitive body 1101 of the image forming apparatus. The photosensitive body 1101 shown in FIG. 11B comprises a support member (support) 1101 for the photosensitive member, and a photosensitive layer 1102 formed on the support. The photosensitive layer 1102 is constituted by a photo-conductive layer 1103 made of a-Si:H, X and having photo-conductivity, and a surface layer 1104 made of amorphous silicon.

Figure 11C:
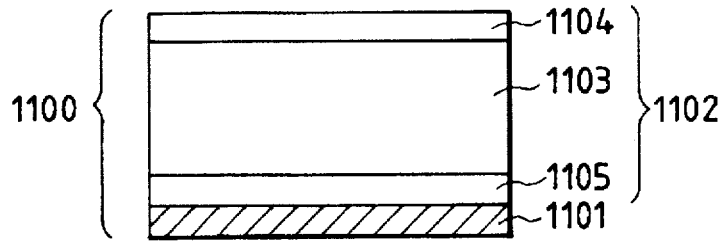

FIG. 11C is a schematic illustration for explaining a further layer structure of the photosensitive body 1101 of the image forming apparatus. The photosensitive body 1101 shown in FIG. 11C comprises a support member (support) 1101 for the photosensitive member, and a photosensitive layer 1102 formed on the support. The photosensitive layer 1102 is constituted by a photo-conductive layer 1103 made of a-Si:H, X and having photo-conductivity, a surface layer 1104 made of amorphous silicon, an electric charge pour-in prevention layer 1105.

Figure 11D:
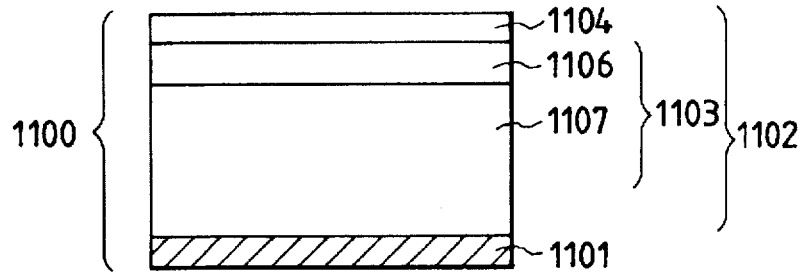
Figure 11E:
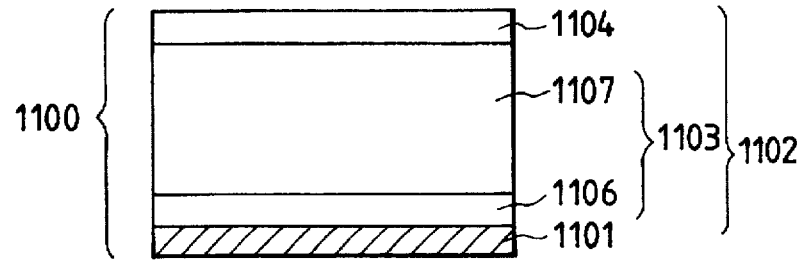

FIG. 11D is a schematic illustration for explaining a still further layer structure of the photosensitive body 1101 of the image forming apparatus. The photosensitive body 1101 shown in FIG. 11C comprises a support member (support) 1101 for the photosensitive member, and a photosensitive layer 1102 formed on the support. The photosensitive layer 1102 is constituted by a charge generating layer 1106 and a charge transferring layer 1107 which constitute a photo-conductive layer 1103 made of a-Si:H, X, a surface layer 1104 made of amorphous silicon.

The support used in the photosensitive body may be conductive or electrically insulating. The conductive support may be formed from metal material such as Al, Cr, Mo, Au, In, Nb, Te, V, Ti, Pt, Pd, Fe, and their alloys (for example, stainless steel). Further, the support may be formed by affording conductivity to at least a surface (forming the photo-conductive layer) of an electrically insulative support member formed from a resin film or a resin sheet made of polyester, polyethylene, polycarbonate, cellulose acetate, polypropylene, polyvinyl chloride, polystyrene polyamide, glass, or ceramic.

The support 1101 may be a cylindrical shape or an endless belt shape having a smooth or uneven surface. Although a thickness of the support is appropriately selected to obtain a desired photosensitive body 1100, when it is requested that the photosensitive body 1100 is flexible, the thickness can be minimized so long as the support 1101 can achieve its function. However, the thickness of the support 1101 is normally 10 μm or more, in consideration of mechanical strength during manufacturing and handling.

Particularly, when the image is formed by using coherent light such as laser light, in order to effectively prevent the poor image due to so-called interference fringes appeared in the visualized image, an uneven surface may be formed on the support 1101 within a range that the charge carriers is not substantially decreased. The unevenness surface (serrations) of the support 1101 can be formed by techniques disclosed in the Japanese Patent Application Laid-Open Nos. 60-168156 (1985), 60-178457 (1985) and 60-225854 (1985).

Further, as another method for effectively preventing the poor image due to so-called interference fringes generated when the image is formed by using coherent light such as laser light, a plurality of semi-spherical dimples may be formed in the surface of the support 1101 within a range that the charge carriers is not substantially decreased. That is to say, the surface of the support 1101 is provided with the plurality of semi-spherical dimples more minute than the resolving power. The plurality of semi-spherical dimples can be formed in the surface of the support 1101 by a known method, as disclosed in the Japanese Patent Application Laid-Open No. 61-231561 (1986).

Further, as still another method for effectively preventing the poor image due to interference fringe when using the coherent light such as laser light, the coherent preventing layer such as light absorbing layer or the area can be provided in or below the photosensitive layer 102.

(Photo-conductive Layer)

In the present invention, a photoconductive layer 1103 formed on the support 1101 or on a lower laid layer (not shown) to form a part of the photosensitive layer 1102 in order to achieve the object effectively is formed through the vacuum accumulate film forming method to thereby realize the predetermined characteristics, by setting the numerical conditions of the film forming parameters. Concretely, it can be formed by various film accumulating methods, for example, glow electric discharge method (alternating current electric discharge CVD method such as low-frequency CVD method, high-frequency CVD method or microwave CVD method, or direct current electric discharge CVD method), spattering method, vacuum vapour method, ion plating method,light CVD method, heat CVD method. These film accumulating methods are selectively used depending the factors such as the manufacturing condition, load degree of equipment capital investment, characteristics necessary for the photosensitive body. However, due to easy the control of conditions upon manufacturing the photosensitive body, the glow electric discharge method, especially high frequency glow electric discharge method using the power source frequency of RF band or VHF band is preferable.

In order to form the photo-conductive layer 1103 by glow electric discharge method, the material gas for Si-supply which can supply the silicon atom (Si) and the material gas for H-supply which can supply the hydrogen atom (H) and/or the material gas for X-supply which can supply the halogen atom (X) are introduced into the reactive container whose inner space can be reduced in pressure under the predetermined gas condition, to thereby generate the glow electric discharge in the reactive container. Thus, the layer made of a-Si:H, X on the predetermined support 1101.

Further, in the present invention, it is necessary that the hydrogen atoms and/or halogen atoms are included in the photo-conductive layer 1103, because the non-bonded hands of the silicon atoms must be compensated to improve the quality of the layer and to improve the photo-conductivity and the charge holding ability. An amount of the hydrogen atoms or halogen atoms, or a total amount of the hydrogen atoms and the halogen atoms is preferably 10 to 30 atom % and more preferably 15 to 25 atom % of the sum of the silicon atoms and the hydrogen atoms and/or halogen atoms.

Substance which can provide Si supplying gas used in the present invention may be gas such as $SiH_4$, $Si_2H_6$, $Si_3H_8$ or $Si_4H_{10}$, or silicon hydride (silane group). Among them, $SiH_4$ or $Si_2H_6$ is preferable in the points that it can easily be handled in the layer formation and that it has good Si supplying efficiency.

Further, in order to introduce the hydrogen atoms into the photo-conductive layer 1103 to be formed, to facilitate the control of introduction rate of hydrogen atoms and to obtain a film feature for achieving the object of the present invention, it is necessary that a predetermined amount of gas such as $H_2$ and/or He or gas of silicon compound including hydrogen atoms is added to the above-mentioned gas to form the layer. Further, not only single gas but also mixed gas may be used.

Substance which can be used as material gas for supplying halogen atoms in the present invention may be gaseous halogen compound or compound which can be gasified, such as halogen gas, halide, halogen-to-halogen compound including halogen or halogen-displaced silane derivative. Further, silicon hydride compound (including halogen atoms) which is gaseous or can be gasified and which has silicon atoms and halogen atoms as constructural components may be used. More specifically, the halogen compound effectively used in the present invention may be halogen-to-halogen compound such as fluorogas ($F_2$), BrF, ClF, $ClF_3$, $BrF_3$, $BrF_5$, $IF_3$ or $IF_7$. The silicon compound including halogen atoms (i.e., halogen-displaced silane derivative) may be, for example, silicon fluoride such as $SiF_4$ or $S_2F_6$.

In order to control the amount of hydrogen atoms and/or halogen atoms included in the photo-conductive layer 1103, for example, a temperature of the support 1101, an amount of material substance (used to adding the hydrogen atoms and/or halogen atoms) introduced into a reaction vessel, and discharging electric power may be controlled.

In the present invention, it is preferable that the photo-conductive layer 1103 includes atoms for controlling conductivity on demand. The atoms for controlling the conductivity may be uniformly distributed in the photo-conductive layer 1103 or may be unevenly distributed in a layer thickness direction.

The atoms for controlling conductivity may be, for example, impurities in the semi-conductor field, and more particularly, may be atoms belonging to IIIb group in a periodic table (referred to as "IIIb group atoms" hereinafter) and having p-type conduction feature or atoms belonging to Vb group in a periodic table (referred to as "Vb group atoms" hereinafter) and having n-type conduction feature. More particularly, the IIIb group atom may be boron (B), aluminium (Al), gallium (Ga), indium (In) or tallium (Tl), and the Vb group atom may be phosphorus (P), arsenic (As), antimony (Sb) or bismuth (Bi), and, in particular, P, As are preferable.

The amount of the atoms for controlling the conductivity contained in the photo-conductive layer 1103 is preferably $1\times10^{-2}$ to $1\times10^{4}$ atom ppm, more preferably $5\times10^{-2}$ to $5\times10^{3}$ atom ppm, and most preferably $1\times10^{-1}$ to $1\times10^{3}$ atom ppm.

In order to structurally introduce the atoms for controlling the conductivity, for example, IIIb group atoms or Vb group atoms, when the layer is formed, material substance for introducing the IIIb group atoms or material substance for introducing the Vb group atoms may be introduced into the reaction vessel in a gaseous form, together with other gases for forming the layer. The material substance for introducing the IIIb group atoms or material substance for introducing the Vb group atoms may have gaseous form in a room temperature or may be easily gasified at least under a layer forming condition.

The material substance for introducing the IIIb group atoms (more particularly, for introducing boron atoms) may be boron hydride such as $B_2H_6$, $B_4H_{10}$, $B_5H_9$, $B_5H_{11}$, $B_6H_{10}$, $B_6H_{12}$ or $H_6H_{14}$, or boron halide such as $BF_3$, $BCl_3$, or $BBr_3$. Alternatively, $AlCl_3$, $GaCl_3$, $Ga(CH_3)_3$, $InCl_3$ or $TlCl_3$ may be used.

The material substance for introducing the Vb group atoms (more particularly, for introducing phosphorus atoms) may be phosphorus hydride such as $PH_3$ or $P_2H_4$, or phosphorus halide such as $PH_4I$, $PF_3$, $PF_5$, $PCl_3$, $PCl_5$, $PBr_3$, $PBr_5$ or $PI_3$. Alternatively, $ASH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ or $BiBr_3$ may be used as the material substance for introducing the Vb group atoms.

Further, if necessary, the material substance for introducing the atoms for controlling the conductivity may be diluted by $H_2$ and/or He.

In the present invention, it is also effective that carbon atoms and/or oxygen atoms and/or nitrogen atoms are included in the photo-conductive layer 1103. An amount of the carbon atoms and/or oxygen atoms and/or nitrogen atoms is preferably $1\times10^{-5}$ to 10 atom %, more preferably $1\times10^{-4}$ to 8 atom % and most preferably $1\times10^{-3}$ to 5 atom % of the sum of silicon atoms, carbon atoms, oxygen atoms and nitrogen atoms. The carbon atoms and/or oxygen atoms and/or nitrogen atoms may be uniformly distributed in the photo-conductive layer or may be unevenly distributed in the layer thickness direction thereof.

In the present invention, the layer thickness of the photo-conductive layer 1103 is determined to provide a desired electrophotographic feature and an economical effect and is preferably 20 to 50 μm, more preferably 23 to 45 μm and most preferably 25 to 40 μm.

In order to form the photo-conductive layer 1103 achieving the object of the present invention and having the desired film feature, it is necessary to appropriately set a mixing ratio between Si supplying gas and the dilute gas, a gas pressure in the reaction vessel, discharge electric power and a temperature of the support.

The flow rate (amount) of $H_2$ and/or He used as the dilute gas is selected in accordance with the layer design, and, normally, it is desirable that the amount of $H_2$ and/or He is greater than that of Si supplying gas by 3 to 20 times, preferably 4 to 15 times and more preferably 5 to 10 times. The gas pressure in the reaction vessel is also selected in accordance with the layer design, and is normally $1\times10^{-4}$ to 10 Torr, preferably $5\times10^{-3}$ to 5 Torr, and more preferably $1\times10^{-3}$ to 1 Torr.

The discharge electric power is also selected in accordance with the layer design, and is greater than the flow amount of Si supplying gas by normally 2 to 7 times, preferably 2.5 to 6 times and more preferably 3 to 5 times. Further, the temperature of the support is also selected in accordance with the layer design, and is preferably 200°C. to 350° C., more preferably 230° to 330° C. and most preferably 250° to 310° C.

In the present invention, while the temperature of the support for constituting the photo-conductive layer and the gas pressure were selected as mentioned above, these are not normally determined independently, but may be determined under relative and functional relation to obtain a photo-conductive layer having a desired feature.

(Surface Layer)

In the present invention, it is preferable that a surface layer 1104 made of amorphous silicon is formed on the photo-conductive layer 1103 formed on the support 1101. The surface layer 1104 has a free surface 1104*a* and serves to achieve the object of the present invention regarding moisture resistance, continuous repeated usage feature, electrical voltage resistance, application environmental feature and endurance.

Further, since the non-crystal materials for forming the photo-conductive layer 1103 and the surface layer 1104 of the photosensitive layer 1102 include silicon atoms in common, the chemical stability can be ensured in the interface between the layers.

The surface layer 1104 may be formed from any amorphous silicon material. For example, such material may be amorphous silicon including hydrogen atoms (H) and/or halogen atoms (X) and also including carbon atoms (referred to as "a-SiC:H,X" hereinafter), amorphous silicon including hydrogen atoms (H) and/or halogen atoms (X) and also including oxygen atoms (referred to as "a-SiO:H,X" hereinafter), amorphous silicon including hydrogen atoms (H) and/or halogen atoms (X) and also including nitrogen atoms (referred to as "a-SiN:H,X" hereinafter), or amorphous silicon including hydrogen atoms (H) and/or halogen atoms (X) and also including at least one of carbon atoms, oxygen atoms and nitrogen atoms (referred to as "a-SiCON:H,X" hereinafter).

In the present invention, in order to achieve the object thereof, the surface layer 1104 is formed by a vacuum deposit film forming method while setting values of film forming parameters to obtain the desired feature. More specifically, for example, the surface layer can be formed by various thin film deposit method such as a glow discharge method (low frequency CVD method, high frequency CVD method, AC discharge CVD method such as micro wave CVD method, or DC discharge CVD method), a spattering method, a vacuum deposit method, an ion plating method, an optical CVD method, a thermal CVD method and the like. Among them, although an appropriate thin film deposit method can be selected in accordance with manufacturing conditions, an estimated cost of equipment, equipment scale and/or the desired feature of the photosensitive body, the deposit method equivalent to the method for forming the photo-conductive layer is preferable in the viewpoint of productivity of photosensitive member.

For example, in order to form the surface layer 1104 consisting of a-SiC:H,X by the glow discharge method, fundamentally, Si supplying material gas capable of supplying silicon atoms (Si), C supplying material gas capable of supplying carbon atoms (C), and H supplying material gas capable of supplying hydrogen atoms (H) and/or X supplying material gas capable of supplying halogen atoms (X) are introduced, in a gaseous form, into the reaction vessel inner pressure of which can be decreased to thereby generate the glow discharge in the reaction vessel, thereby forming a layer consisting of a-SiC:H,X on the support 1101 on which the photo-conductive layer 1103 was already formed.

Although material of the surface layer 1104 used in the present invention may be any amorphous material including silicon, compound of silicon atom including at least one of carbon atoms, nitrogen atoms and oxygen atoms is preferable, and, material mainly including a-SiC is more preferable. When the surface layer 1104 is mainly formed from a-SiC, an amount of carbon is preferably 30 to 90% of the sum of silicon atoms and carbon atoms.

Further, in the present invention, it is necessary that hydrogen atoms and/or halogen atoms are included in the surface layer 1104 because the non-bonded hands of silicon atoms must be compensated and quality of the layer (particularly, photo-conductive feature and charge holding ability) must be improved. Normally, the amount of hydrogen is 30 to 70 atom %, preferably 35 to 65 atom % and more preferably 40 to 60 atom % of the total atom amount. Further, the amount of fluorine atoms is normally 0.01 to 15 atom %, preferably 0.1 to 10 atom % and more preferably 0.6 to 4 atom %.

The photosensitive body having the above-mentioned amount of hydrogen and/or fluorine is considerably superior to the conventional ones. That is to say, it is known that the defect (mainly, dangling bonds of silicon atoms and carbon atoms) of the surface layer affects a bad influence upon the feature of the photosensitive body of the image forming apparatus. For example, such bad influence is deterioration of the charging feature due to the pour-in of charges from the free layer 1104*a* into the photo-conductive layer, change in application condition (for example, fluctuation in the charging feature due to change in surface structure under the high humidity environment), and generation of an afterimage phenomenon during repeated usage due to the pour-in of charges into the surface layer 1104 of the photo-conductive layer 1103 during corona charging and light illumination and due to the trapping of charges in the defect in the surface layer 1104.

However, by controlling the amount of hydrogen in the surface layer 1104 to 30 atom % or more, the defect of the surface layer 1104 is greatly reduced, with the result that the electrical feature and the high speed continuous usage ability can be considerably improved in comparison with the conventional techniques.

On the other hand, if the amount of hydrogen in the surface layer 1104 exceeds 71 atom %, since the hardness of the surface layer 1104 is decreased, the surface layer cannot be repeatedly used. Accordingly, the selection of the amount of hydrogen in the surface layer 1104 within the above-mentioned range is one of very important factors for providing the desired excellent electrophotographic feature. The amount of hydrogen in the surface layer 1104 can be controlled by the flow rate of $H_2$ gas, temperature of the support, discharge power and/or gas pressure.

Further, by controlling the amount of fluorine in the surface layer 1104 to 0.01 atom % or more, the bonding between silicon atoms and carbon atoms in the surface layer 1104 can be achieved more effectively. Further, by the action of fluorine atoms in the surface layer 1104, disconnection between silicon atoms and carbon atoms due to damage such as corona can be prevented effectively.

On the other hand, if the amount of fluorine in the surface layer 1104 exceeds 15 atom %, the effect for achieving the bonding between silicon atoms and carbon atoms in the surface layer 1104 and the effect for preventing the disconnection between silicon atoms and carbon atoms cannot be expected. Further, the excessive fluorine atoms prevent the movability of the carriers in the surface layer 1104, thereby increasing the residual potential and image memory. Accordingly, the selection of the amount of fluorine in the surface layer 1104 within the above-mentioned range is one of very important factors for providing the desired excellent electrophotographic feature. As is in the amount of hydrogen, the amount of hydrogen in the surface layer 1104 can be controlled by the flow rate of $H_2$ gas, temperature of the support, discharge power and/or gas pressure.

Substance which can provide silicon (Si) supplying gas used for forming the surface layer 1104 of the present invention may be gaseous silicon hydride (silane group) or silicon hydride which can be gasified, such as $SiH_4$, $Si_2H_6$, $Si_3H_8$ or $Si_4H_{10}$. Among them, $SiH_4$ or $Si_2H_6$ is preferable in the points that it can easily be handled in the layer formation and that it has good Si supplying efficiency. Further, if necessary, the Si supplying gas may be diluted by gas such as $H_2$, He, Ar or Ne.

Substance which can be used as gas for supplying carbon may be gaseous hydrocarbon or hydrocarbon which can be gasified, such as $CH_4$, $C_2H_6$, $C_3H_8$ or $C_4H_{10}$. Among them, $CH_4$ or $C_2H_6$ is preferable in the points that it can easily be handled in the layer formation and that it has good Si supplying efficiency. Further, if necessary, the C supplying gas may be diluted by gas such as $H_2$, He, Ar or Ne.

Substance which can be used as gas for supplying nitrogen or oxygen may be gaseous compound or compound which can be gasified, such as $NH_3$, NO, $N_2O$, $NO_2$, $H_2O$, $O_2$, CO, $CO_2$ or $N_2$. Further, if necessary, the nitrogen or oxygen supplying gas may be diluted by gas such as $H_2$, He, Ar or Ne.

In order to easily control the amount of hydrogen atoms introduced into the surface layer 1104, hydrogen gas or silicon compound including hydrogen atoms may be added to the above gas by a predetermined amount to form the layer. The single gas or mixed gas (mixed at a predetermined rate) may be used.

Substance which can be used as material gas for supplying halogen atoms may be, for example, gaseous halogen compound or compound which can be gasified, such as halogen gas, halide, halogen-to-halogen compound including halogen or halogen-displaced silane derivative. Further, silicon hydride compound (including halogen atoms) which is gaseous or can be gasified and which has silicon atoms and hydrogen atoms as constructural components may be used. More particularly, the halogen compound effectively used in the present invention may be halogen-to-halogen compound such as fluorogas ($F_2$), BrF, ClF, $ClF_3$, $BrF_3$, $BrF_5$, $IF_3$ or $IF_7$. The silicon compound including halogen atoms (i.e., halogen-displaced silane derivative) may be, for example, silicon fluoride such as $SiF_4$ or $Si_2F_6$.

In order to control the amount of hydrogen atoms and/or halogen atoms included in the surface layer 1104, for example, a temperature of the support 1101, an amount of material substance (used to adding the hydrogen atoms and/or halogen atoms) introduced into the reaction vessel, and discharging electric power may be controlled.

The carbon atoms and/or oxygen atoms and/or nitrogen atoms may be uniformly distributed in the surface layer 1104 or may be unevenly distributed in a layer thickness direction thereof. Further, in the present invention, it is preferable that the surface layer 1104 includes atoms for controlling conductivity. The atoms for controlling conductivity may be uniformly distributed in the surface layer 1104 or may be unevenly distributed in a layer thickness direction thereof.

The atoms for controlling conductivity may be, for example, impurities in the semi-conductor field, and more preferably, may be atoms belonging to IIIb group in a periodic table (referred to as "IIIb group atoms" hereinafter) and having p-type conduction feature or atoms belonging to Vb group in a periodic table (referred to as "Vb group atoms" hereinafter) and having n-type conduction feature. More particularly, the IIIb group atom may be boron (B), aluminium (Al), gallium (Ga), indium (In) or tallium (Tl), and, in particular, B, Al, Ga are preferable. The Vb group atom may be phosphorus (P), arsenic (As), antimony (Sb) or bismuth (Bi), and, in particular P, As are preferable.

The amount of the atoms for controlling the conductivity contained in the surface layer 1103 is preferably $1\times10^{-3}$ to $1\times10^{3}$ atom ppm, more preferably $1\times10^{-2}$ to $5\times10^{2}$ atom ppm, and most preferably $1\times10^{-1}$ to $1\times10^{2}$ atom ppm. In order to structurally introduce the atoms for controlling the conductivity, for example, IIIb group atoms or Vb group atoms, when the layer is formed, material substance for introducing the IIIb group atoms or material substance for introducing the Vb group atoms may be introduced into the reaction vessel in a gaseous form, together with other gases for forming the surface layer 1104. The material substance for introducing the IIIb group atoms or material substance for introducing the Vb group atoms may have gaseous form in a room-temperature or may be easily gasified at least under a layer forming condition. The material substance for introducing the IIIb group atoms (more particularly, for introducing boron atoms ) may be boron hydride such as $B_2H_6$, $B_4H_{10}$, $B_5H_9$, $B_5H_{11}$, $B_6H_{10}$, $B_6H_{12}$ or $B_6H_{14}$, or boron halide such as $BF_3$, $BCl_3$ or $BBr_3$. Alternatively, $AlCl_3$, $GaCl_3$, $Ga(CH_3)_3$, $InCl_3$ or $TlCl_3$ may be used.

The material substance for introducing the Vb group atoms (more particularly, for introducing phosphorus atoms) may be phosphorus hydride such as $PH_3$ or $P_2H_4$, or phosphorus halide such as $PH_4I$, $PF_3$, $PF_5$, $PCl_3$, $PCl_5$, $PBr_3$, $PBr_5$ or $PI_3$. Alternatively, $AsH_3$, $AsF_3$, $AsCl_3$, $AsBr_3$, $AsF_5$, $SbH_2$, $SbF_3$, $SbF_5$, $SbCl_3$, $SbCl_5$, $BiH_3$, $BiCl_3$ or $BiBr_3$ may be used as the material substance for introducing the Vb group atoms.

Further, if necessary, the material substance for introducing the atoms for controlling the conductivity may be diluted by gas such as $H_2$, He, Ar or Ne.

In the present invention, the layer thickness of the surface layer 1104 is preferably 0.01 to 3 μm, more preferably 0.05 to 2 μm and most preferably 0.1 to 1 μm. If the layer thickness is smaller than 0.01 μm, during usage of the photosensitive member, the surface layer 1104 is worn out; whereas, if the layer thickness is greater than 3 μm, the residual potential will be increased, thereby worsening the electrophotographic feature.

The surface layer 1104 of the present invention is carefully formed to provide the desired feature. That is to say, the substance including silicon, carbon and/or nitrogen and/or oxygen, and hydrogen and/or halogen can be changed in its form from crystal to amorphous silicon, and electrical feature thereof can be changed from conductive through semi-conductive to insulative, and further optical feature thereof can be changed from photo-conductive to non-photo-conductive. Thus, in the present invention, the conditions for forming the surface layer 1104 are severely selected to provide the compound having the desired features.

For example, when the surface layer 1104 is used to mainly improve the endurance, it is formed as non single crystal material providing noticeable electrical insulation feature. On the other hand, when the surface layer 1104 is used to mainly improve the continuous repeated usage feature and/or application environmental feature, it is formed as non single crystal material in which the electrical insulation feature is weakened to some extent and sensitivity to the illumination light can be provided to some extent. Further, in the charging mechanism, in order to prevent the image flow and influence of residual potential due to low resistance of the surface layer 1104 and to enhance the charging efficiency, when the layer is formed, it is preferable that a resistance value of the surface layer is controlled appropriately.

In order to form the surface layer 1104 achieving the object of the present invention, it is necessary to appropriately set the temperature of the support 1101 and the gas pressure in the reaction vessel, as desired.

The temperature (Ts) of the support is selected in accordance with the layer design, and is preferably 200° to 350°

C., more preferably 230° to 330° C. and most preferably 250° to 330° C.

The gas pressure in the reaction vessel is also selected in accordance with the layer design, and is normally $1\times10^{-4}$ to 10 Torr, preferably $5\times^{-3}$ to 5 Torr, and more preferably $1\times10^{-3}$ to 1 Torr.

In the present invention, while the desired values of the support temperature and gas pressure for forming the surface layer 1104 were explained as mentioned, normally, these conditions are not determined independently but may be relatively and functionally determined to form the photosensitive body having the desired feature.

Further, between the photo-conductive layer 1103 and the surface layer 1104, by providing a blacking layer (lower surface layer) including carbon atoms, oxygen atoms and nitrogen atoms amounts of which are smaller than those in the surface layer 1104, the charging ability can be further improved.

Alternatively, between the photo-conductive layer 1103 and the surface layer 1104, a zone including carbon atoms and/or oxygen atoms and/or nitrogen atoms amounts of which are gradually decreased from the surface layer to the photo-conductive layer 1103 may be provided. With this arrangement, the close contact between the surface layer 1104 and the photo-conductive layer 1103 can be improved, thereby reducing the influence due to interference of reflected light at the interface.

(Charge Pour-in Prevention Layer)

In the photosensitive body of the image forming apparatus according to the present invention, it is more effective that a charge pour-in prevention layer 1105 for preventing charge pour-in from the conductive support is disposed between the conductive support 1101 and the photo-conductive layer 1103. That is to say, when the free surface 1104*a* of the photosensitive layer 1102 is subjected to the charging having predetermined polarity, the charge pour-in prevention layer 1105 has a function for preventing the charges from being poured in from the support to the photo-conductive layer. However, when the free surface is subjected to the charging having opposite polarity, such a function is not performed. Namely, the charge pour-in prevention layer has polarity dependency. In order to provide such a function, the atoms for controlling conductivity are included in the charge pour-in prevention layer 1105 more than in the photo-conductive layer 1103.

The atoms for controlling conductivity included in the charge pour-in prevention layer may be uniformly distributed in the layer or may be uniformly distributed in a layer thickness direction thereof or may be unevenly distributed in the layer thickness direction thereof. When the uneven distribution is adopted, it is desirable that density of the atoms is greater near the support. However, in any cases, it is necessary that the atoms are uniformly distributed in each plane parallel to the surface of the support 1101 to obtain the uniform feature.

The atoms for controlling conductivity included in the charge pour-in prevention layer 1105 may be, for example, impurities in the semi-conductor field, and more particularly, may be atoms belonging to III group in a periodic table (referred to as "III group atoms" hereinafter) and having p-type conduction feature or atoms belonging to V group n a periodic table (referred to as "V group atoms" hereinafter) and having n-type conduction feature. More particularly, the III group atom may be boron (B), aluminum (Al), gallium (Ga), indium (In) or thallium (T), and, in particular, B, Al, Ga are preferable. The V group atom may be phosphorus (P), arsenic (As), antimony (S) or bismuth (Bi), and, in particular, P, As are preferable.

In the present invention, the amount of the atoms for controlling the conductivity contained in the charge pour-in prevention layer 1105 is appropriately determined as desired to effectively achieve the object of the present invention, and is preferably 10 to $1\times10^4$ atom ppm, more preferably 50 to $5\times10^3$ atom ppm, and most preferably $1\times10^2$ to $1\times10^3$ atom ppm.

Further, by introducing at least one of carbon atoms, nitrogen atoms and oxygen atoms into the charge pour-in prevention layer 1105, the contacting ability between the charge pour-in prevention layer 1105 and other layers directly contacted therewith can be further improved.

The carbon atoms, nitrogen atoms or oxygen atoms included in the layer may be uniformly distributed in the layer or may be uniformly distributed in a layer thickness direction thereof or may be unevenly distributed in the layer thickness direction thereof. When the uneven distribution is adopted, it is desirable that density of the atoms is greater near the support. However, in any cases, it is necessary that the atoms are uniformly distributed in each plane parallel to the surface of the support 1101 to obtain the uniform feature.

The amount of carbon atoms and/or nitrogen atoms and/or oxygen atoms included in the entire area of the charge pour-in prevention layer 1105 is appropriately determined to effectively achieve the object of the present invention. In case of single kind of atoms, the amount of atoms (and, in case of two or more kinds of atoms, the sum of amounts of atoms) is preferably $1\times10^{-3}$ to 50 atom %, more preferably $5\times10^{-3}$ to 30 atom %, and most preferably $1\times10^{-2}$ to 10 atom %.

The hydrogen atoms and/or halogen atoms included in the charge pour-in prevention layer 1105 serve to compensate the non-bonded hands existing in the layer and to improve the film quality. The amount of hydrogen atoms or halogen atoms included in the charge pour-in prevention layer 1105, or, the sum of amounts of hydrogen atoms and halogen atoms is preferably 1 to 50 atom %, more preferably 5 to 40 atom %, and most preferably 10 to 30 atom %.

In the present invention, the layer thickness of the charge pour-in prevention layer 1105 is selected to provide the desired electrophotographic feature and to achieve the economical feature and is preferably 0.1 to 5 μm, more preferably 0.3 to 4 μm, and most preferably 0.5 to 3 μm. Further, in order to form the charge pour-in prevention layer 1105, the same vacuum deposit method as that used in the formation of the photo-conductive layer 1103 can be used.

In order to form the charge pour-in prevention layer 1105 having the feature for achieving the object of the present invention, as is in the photo-conductive layer 1103, it is necessary that the mixing ratio between the Si supplying gas and the dilute gas, the gas pressure in the reaction vessel, the discharge electric power and the temperature of the support 1101 are appropriately set.

The flow amount of $H_2$ and/or He as dilute gas is appropriately selected in accordance with the layer design. Normally, the amount of $H_2$ and/or He is greater than the amount of Si supplying gas by 1 to 20 times, preferably 3 to 15 times, and more preferably 5 to 10 times. The gas pressure in the reaction vessel is also selected in accordance with the layer design, and is normally $1\times10^{-4}$ to 10 Torr, preferably $5\times10^{-3}$ to 5 Torr, and more preferably $1\times10^{-3}$ to 1 Torr.

Similarly, the discharge electric power is also selected in accordance with the layer design, and is greater than the flow amount of Si supplying gas by normally 1 to 7 times, preferably 2 to 6 times, and more preferably 3 to 5 times. Further, the temperature of the support is selected in accordance with the layer design, and is preferably 200° to 350° C., more preferably 230° to 330° C. and most preferably 250° to 300° C.

In the present invention, while the desired values of the dilute gas mixing ratio, gas pressure, discharge electric power and support temperature for forming the charge pour-in prevention layer 1105 were explained as mentioned, normally, these conditions are not determined independently but may be relatively and functionally determined to form the photosensitive body having the desired feature.

In addition, in the photosensitive body of the image forming apparatus, it is desirable that, in the vicinity of the support 1101 of the photosensitive layer 1102, there is provided a layer zone in which at least aluminium atoms, silicon atoms, hydrogen atoms and/or halogen atoms are unevenly distributed in a layer thickness direction.

Further, in the photosensitive body of the image forming apparatus, in order to further improve the close contact between the support 1101 and the photo-conductive layer 1103 or the charge pour-in prevention layer 1105, for example, there may be provided a close contact layer formed from non-crystal material based on $Si_3N_4$, $SiO_2$, SiO or silicon atoms and including hydrogen atoms and/or halogen atoms, and carbon atoms and/or oxygen atoms and/or nitrogen atoms. Further, as mentioned above, a light absorbing layer for preventing generation of interference fringes due to light reflected from the support 1101 may be provided.

Figure 2:
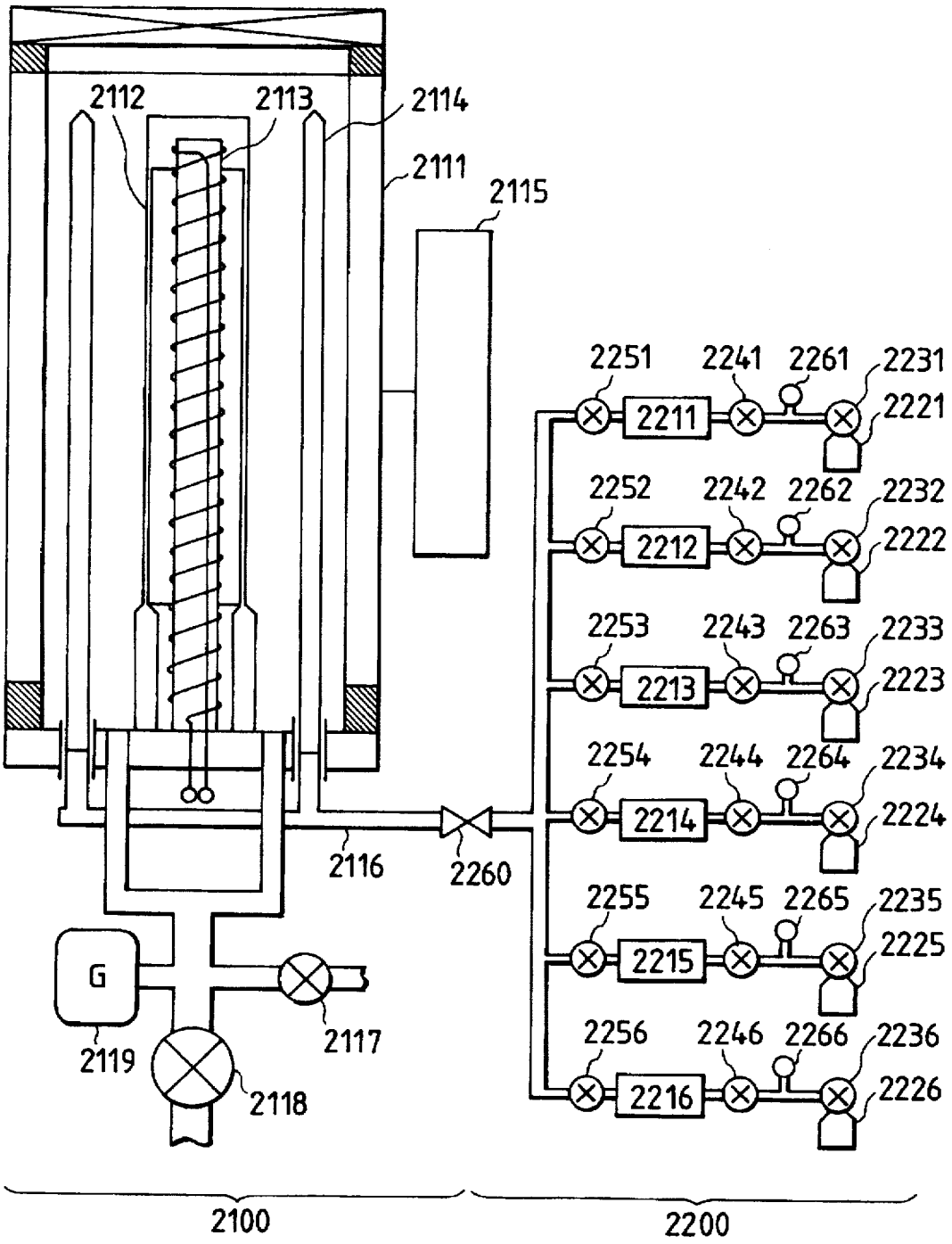
FIG. 2 is a schematic illustration showing an apparatus for manufacturing a photosensitive member of an image forming apparatus by a flow discharge method using high-frequency wave having RF band as an example of an apparatus for forming a light receiving layer of the photosensitive member.

Next, an apparatus and a film forming method for forming the photosensitive layer 1102 will be explained. FIG. 2 is a schematic illustration showing an example of an apparatus for manufacturing a photosensitive member of an image forming apparatus by utilizing a high frequency plasma CVD method using RF band as power source frequency (referred to as "RF-PCVD" hereinafter).

The apparatus comprises a deposit device 2100, a material gas supplying device 2200, and an exhaust device (not shown) for reducing pressure in a reaction vessel 2111. A cylindrical support member 2112, a support heating heater 2113 and material gas introducing pipes 2114 are disposed within the reaction vessel 2111 of the deposit device 2100, and a high frequency matching box 2115 is connected to the deposit device.

The material gas supplying device 2200 includes gas tanks 2221 to 2226 for containing material gases such as $SiH_4$, $GeH_4$, $H_2$, $CH_4$, $B_2H_6$, $PH_3$ and the like, valves 2231 to 2236 for the respective gas tanks, flow-in valves 2241 to 2246, flow-out valves 2251 to 2256 and mass-flow controllers 2211 to 2216. The material gas tanks 2221 to 2226 are connected to the gas introducing pipes 2114 in the reaction vessel 2111 through an auxiliary valve 2260.

The deposit film can be formed by using the abovementioned apparatus, for example, in the following manner.

First of all, the cylindrical support member 2112 is disposed within the reaction vessel 2111, and air in the reaction vessel is removed by the exhaust device (for example, a vacuum pump). Then, a temperature of the cylindrical support member 2112 is controlled to a predetermined temperature of 200° to 350° C. by means of the support heating heater 2113.

In order to introduce the material gas for forming the deposit film into the reaction vessel 2111, after it is ascertained that the valves 2231 to 2236 for the respective gas tanks are closed and that a leak valve 2117 of the reaction vessel 2111 is closed and that the flow-in valves 2241 to 2246, flow-out valves 2251 to 2256 and auxiliary valve 2260 are opened, first of all, a main valve 2118 is opened to remove air or gas from the reaction vessel 2111 and a gas pipe 2116.

Then, the auxiliary valve 2260 and flow-out valves 2251 to 2256 are closed when a value of a vacuum meter 2119 becomes about $5\times10^{-6}$ Torr. Thereafter, the gases are supplied from the gas tanks 2221 to 2226 by opening the valves 2231 to 2236, and pressure of each gas is adjusted to 2 $kg/cm^2$ by pressure regulators 2261 to 2266. Then, the flow-in valves 2241 to 2246 are gradually opened to introduce the gases into the mass-flow controllers 2211 to 2216.

In this way, the preparation for forming the film is completed. Then, the layers are formed in the following procedures.

When the temperature of the cylindrical support 2112 reaches the predetermined value, the desired one or more valves 2251 to 2256 and the auxiliary valve 2260 are gradually opened so that the desired gases from the gas tanks 2221 to 2226 are introduced into the reaction vessel 2111 through the gas introducing pipes 2114. Then, the amounts of gases are adjusted to have their desired values by means of the mass-flow controllers 2211 to 2216. In this case, the opening degree of the main valve 2118 is adjusted while checking the value of the vacuum meter 2119 so that the pressure in the reaction vessel becomes a predetermined value smaller than 1 Torr. After the pressure in the vessel is stabilized, an RF power source (not shown) having frequency of 13.56 MHz is set to predetermined power, and then, RF electric power is introduced into the reaction vessel 2111 through the high frequency matching box 2115, thereby generating glow discharge. The material gases introduced into the reaction vessel 2111 are decomposed by the discharge energy, with the result that a predetermined deposit film mainly including silicon is formed on the cylindrical support 2112. After the deposit film having a predetermined thickness is formed, the RF electric power is stopped, and then, the flow out valves are closed to stop the introduction of gases into the reaction vessel 2111. In this way, the formation of one of the layers is finished.

By repeating similar operations, a photosensitive layer having desired layer structure can be formed.

It should be noted that, when a certain layer is formed, the flow-out valves other than that relating to the formation of that layer are closed, and, in order to prevent the gases from remaining in the reaction vessel 2111 and in pipe lines extending from the flow-out valves 2251 to 2256 to the reaction vessel 2111, the system is made vacuum once by closing the flow-out valves 2251 to 2256 and by opening the auxiliary valve 2260 and by fully opening the main valve 2118, if necessary.

Further, in order to make the thickness of the layer uniform, it is effective that the support 2112 is rotated at a constant speed by a drive device (not shown) while the layer is being formed. Incidentally, it is to be understood that the kinds of used gases and the valve operations are changed in accordance with the various layer forming conditions.

Next, a method for manufacturing a photosensitive member of an image forming apparatus formed by a high frequency plasma CVD method using VHF band frequency as an electric source (referred to as "VHF-PCVD" hereinafter) will be explained.

In place of the deposit device 2100 (effecting the RF-PCVD method) of the manufacturing apparatus shown in FIG. 2, by connecting a deposit device 3100 shown in FIG. 3 to the material gas supplying device 2200, a manufacturing apparatus for manufacturing a photosensitive member by the VHF-PCVD method can be obtained. incidentally, since a material gas supplying device 2200 in the VHF-PCVD method is the same as that shown in FIG. 2, such a device 2200 will be explained with reference to FIG. 2.

The manufacturing apparatus comprises a reaction vessel 3111 vacuum-sealed type in which pressure therein can be reduced, a material gas supplying device 2200, and an exhaust device (not shown) for reducing the pressure in the reaction vessel 3111. A cylindrical support 3112, a support heating heater 3113, a material gas introducing pipe 3114 and an electrode 3115 are disposed within the reaction vessel 3111, and a high frequency matching box 3116 is connected to the electrode 3115.

The material gas supplying device 2200 includes gas tanks 2221 to 2226 for containing material gases such as $SiH_4$, $GeH_4$, $H_2$, $CH_4$, $B_2H_6$, $PH_3$ and the like, valves 2231 to 2236 for the respective gas tanks, flow-in valves 2241 to 2246, flow-out valves 2251 to 2256 and mass-flow controllers 2211 to 2216. The material gas tanks 2221 to 2226 are connected to the gas introducing pipe 3114 in the reaction vessel 3111 through an auxiliary valve 2260. Further, a space 3130 enclosed by the cylindrical support 3112 defines a discharge space.

The deposit film can be formed in the apparatus by using the VHF-PCVD method, for example, in the following manner. First of all, the cylindrical support member 3112 is disposed within the reaction vessel 3111 and is rotated by the drive device 3120, and air in the reaction vessel is removed by the drive device 3120, and air in the reaction vessel is removed by the exhaust device (for example, a vacuum pump not shown) through an exhaust pipe 3121. The pressure in the reaction vessel 3111 is adjusted to become $1\times10^{-7}$ or less. Then, a temperature of the cylindrical support 3112 is controlled to a predetermined temperature of 200° to 350° C. by means of the support heating heater 3113.

In order to introduce the material gas for forming the deposit film into the reaction vessel 3111, after it is ascertained that the valves 2231 to 2236 for the respective gas tanks are closed and that a leak valve (not shown) of the reaction vessel 3111 is closed and that the flow-in valves 2241 to 2246, flow-out valves 2251 to 2256 and auxiliary valve 2260 are opened, first of all, a main valve (not shown) is opened to remove air or gas from the reaction vessel 3111 and a gas pipe (not shown).

Then, the auxiliary valve 2260 and flow-out valves 2251 to 2256 are closed when a value of a vacuum meter becomes about $5\times10^{-6}$ Torr. Thereafter, the gases are supplied from the gas tanks 2221 to 2226 by opening the valves 2231 to 2236, and pressure of each gas is adjusted to 2 kg/cm$^2$ by pressure regulators 2261 to 2266. Then, the flow-in valves 2241 to 2246 are gradually opened to introduce the gases into the mass-flow controllers 2211 to 2226.

In this way, the preparation for forming the film is completed. Then, the layers are formed on the cylindrical support 3112 in the following procedures.

When the temperature of the cylindrical support 3112 reaches the predetermined value, the desired one or more valves 2251 to 2256 and the auxiliary valve 2260 are gradually opened so that the desired gases from the gas tanks 2221 to 2226 are introduced into the reaction vessel 3111 through the gas introducing pipe 3114. Then, the amounts of gases are adjusted to have their desired values by means of the mass flow controllers 2211 to 2216. In this case, the opening degree of the main valve is adjusted while checking the value of the vacuum meter so that the pressure in the discharge space 3130 becomes a predetermined value smaller than 1 Torr.

After the pressure in the vessel is stabilized, a VHF power source (not shown) having frequency of 500 MHz is set to predetermined power, and then, VHF electric power is introduced into the discharge space 3130 through the matching box 3120, thereby generating glow discharge. The material gases introduced into the discharge space 3130 enclosed by the cylindrical support 3112 are decomposed by the discharge energy, with the result that a predetermined deposit film is formed on the cylindrical support 3112. In this case, the cylindrical support is rotate at a predetermined speed by a support rotating motor 3120 in order to make the thickness of the film uniform.

After the deposit film having a predetermined thickness is formed, the VHF electric power is stopped, and then, the flow-out valves are closed to stop the introduction of gases into the reaction vessel 3111. In this way, the formation of one of the layers is finished.

By repeating similar operations, a photosensitive layer having desired layer structure can be formed.

It should be noted that, when a certain layer is formed, the flow-out valves other than that relating to the formation of that layer are closed, and, in order to prevent the gases from remaining in the reaction vessel 3111 and in pipe lines extending from the flow-out valves 2251 to 2256 to the reaction vessel 3111, the system is made vacuum once by closing the flow-out valves 2251 to 2256 and by opening the auxiliary valve 2260 and by fully opening the main valve, if necessary.

Incidentally, it is to be understood that the kinds of used gases and the valve operations are changed in accordance with the various layer forming conditions.

In both methods, when the deposit film is formed, the temperature of the support may be maintained to 200° to 350° C., preferably 230° to 330° C., and more preferably 250° to 300° C.

The heater for heating the cylindrical support 3112 can be operated under the vacuum condition and, more specifically, may be an electrical resistance heating body such as a sheath-shaped winding heater, a plate-shaped heater, a ceramic heater and the like, a heat radiation lamp heating body such as a halogen lamp, a infrared ray lamp and the like, or a heating body using a heat exchange means via liquid or gas. A surface material of the heating means may be formed from metal material such as stainless steel, nickel, aluminium, copper and the like, ceramic material, or heat-resistance polymer resin material.

Alternatively, in addition to the reaction vessel 3111, a vessel or container for exclusively effecting the heating may be provided, and, after heating, the cylindrical support 3112 is conveyed within the reaction vessel 3111 under the vacuum condition. Further, particularly, in the VHF-PCVD method, it is desirable that the pressure in the discharge space is set to preferably 1 to 500 mTorr, more preferably 3 to 300 mTorr, and most preferably 5 to 100 mTorr.

In the VHF-PCVD method, the dimension and configuration of the electrode 3115 disposed within the discharge space 3130 may be selected freely so long as the discharge is not disturbed. However, in practice, preferably, it has a cylindrical shape having a diameter of 1 mm to 10 cm. In this case, a length of the electrode 3115 may be selected freely so long as the cylindrical support 3112 is subjected to uniform electric field.

Material of the electrode 3115 is not limited so long as it is conductive, and, normally, metal such as stainless steel, Al, Cr, Mo, Au, In, Nb, Te, V, Ti, Pt, Pb, Fe and their alloys, or glass, ceramic, plastic and the like a surface of which is made conductive can be used as the electrode.

Figure 10:
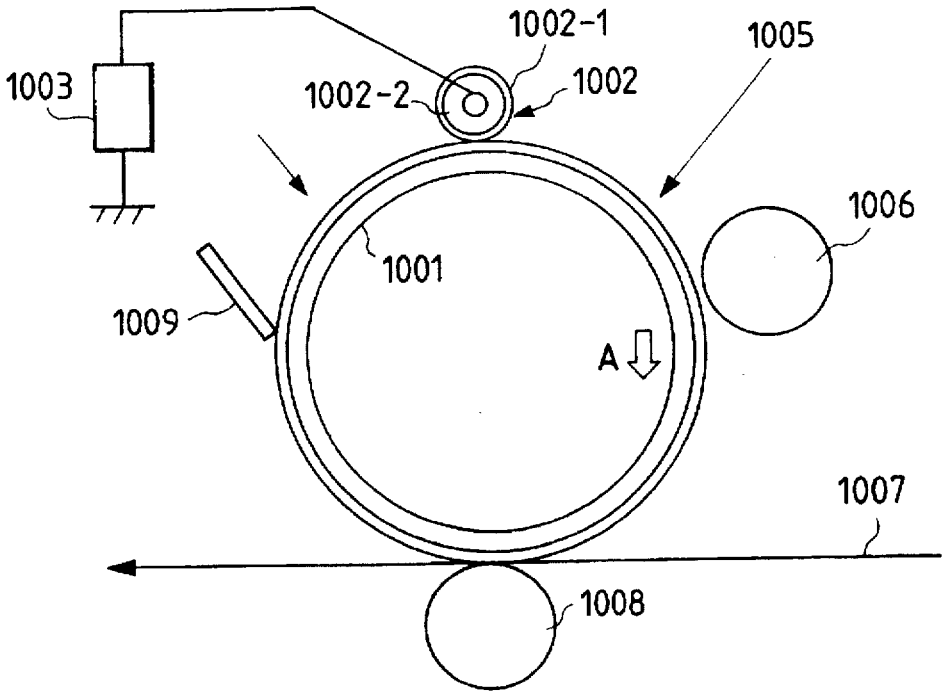
FIG. 10 is a side view of a main portion of an image forming apparatus according to a first embodiment of the present invention.

By using the above-mentioned structures and functions independently or in combination, the excellent advantage can be derived, and an example is shown in FIG. 10. In FIG. 10, a drum-shaped electrophotographic photosensitive member, i.e., image bearing member (member to be charged) 1001 is rotated in a direction (clockwise direction in FIG. 10) at a predetermined peripheral speed (process speed).

It is preferable that a resistance value of a surface layer of the photosensitive member 1001 has $1\times10^{10}$ to $5\times10^{15}$ Ω.cm in order to improve electric features such as charge holding ability and charging efficiency and to prevent pin hole leak (damage of surface layer due to voltage). More preferably, the resistance value is $1\times10^{12}$ to $1\times10^{14}$ Ω.cm. The resistance value (when subjected to voltage of 0.25 to 1 kV) is measured by an MΩ tester manufactured by HIOKI Co. Ltd.

A contact charge member 1002 using the charge carriers includes a multi pole magnetic member 1002-2 and a magnet brush layer 1002-1 consisting of charger carriers (magnetic powder particles) formed on the multi pole magnetic member. The multi pole magnetic member 1002-2 of the contact charge member 1002 is provided at its surface with magnetic poles arranged in a spiral fashion. For example, as shown in FIG. 1B, the spiral arrangement of magnetic poles may be constituted by combining magnets and resin blocks which are both arranged in a spiral fashion, or by embedding magnetic bodies such as rubber magnets in a sleeve-shaped permeable cylinder. Further, after the contact charge member 1002 was manufactured by forming the magnet brush layer 1002-1 on the multi pole magnetic member 1002-2, for example, a permeable and conductive tape such as a copper tape or an aluminum tape (for example, electrical tapes 1181 and 1170 manufactured by 3M corp.) may be provided or the above-mentioned permeable conductive layer may be provided so that voltage can be uniformly applied to the magnet brush layer 1002-1 when the voltage is applied to the charge member.

As mentioned above, the magnet brush layer 1002-1 is constituted by charge carriers consisting of magnetic ferrite, magnetic magnesium or magnetic toner carrier.

It is preferable that a resistance value (when subjected to voltage of 0.25 to 1 kV) of the magnet brush layer 1002-1 of the contact charge member 1002 is $1\times10^{3}$ to $1\times10^{12}$ Ω.cm measured by an MΩ tester manufactured by HIOKI Co. Ltd to maintain the good charging efficiency and to prevent the pin hole. More preferably, the resistance value is $1\times10^{4}$ to $1\times10^{8}$ Ω.cm.

It is preferable that a minimum distance between the photosensitive member 1001 and the multi pole magnetic member 1002-2 is stably set to 50 to 2000 μm to control the charge nip by a spacer (not shown). More preferably, the distance is 100 to 1000 μm. In addition, a charge nip adjusting mechanism such as a blade may be provided.

An electric power source 1003 serves to apply voltage to the contact charge member 1002. When the DC voltage $V_{dc}$ is applied from the electric power source 1003 to the magnet brush layer 1002-1 consisting of charge carriers, the outer peripheral surface (surface) of the photosensitive member 1001 is uniformly charged.

Further, by scanning the photosensitive member 1001 by a laser beam 1005 intensity of which is modulated in response to an image signal, an electrostatic latent image is formed on the photosensitive member 1001. The electrostatic latent image is visualized with developing agent (toner) by a developing sleeve 1006 as a toner image which is in turn transferred onto a transfer material 1007 by means of a transfer roller 1008. The transfer material 1007 to which the toner image was transferred is sent to a fixing device (not shown), where the toner image is fixed to the transfer material. Then, the transfer material is discharged out of a body (not shown) of the image forming apparatus. On the other hand, after the transferring operation, residual toner remaining on the photosensitive drum 1001 is removed by a cleaning blade 1009 for preparation for next image formation.

Now, concrete examples with numerical values will be explained. Incidentally, the present invention is not limited to such examples.

<EXAMPLE 1>

A photosensitive body consisting of a charge pour-in preventing layer, a photo-conductive layer and a surface layer was formed on a mirror-finished aluminium cylinder (support) having a diameter of 108 mm by using the manufacturing apparatus for manufacturing the photosensitive member utilizing the RF-PCVD method (FIG. 2) under the conditions shown in FIG. 14. Further, by changing the mixing ratio between $SiH_4$ and $H_2$ of the photo-conductive layer and the discharge electric power, various photosensitive members were manufactured.

The manufactured photosensitive members were mounted on an image forming apparatus (test apparatus modified from NP 6060 of Canon Inc.), respectively, and temperature dependency of charging ability (temperature characteristic), memory and image defect were evaluated.

Regarding the temperature characteristic, the charging abilities were measured at the temperature of the photosensitive member from the room temperature to 45° C., and, when the change in the charging ability per 1° C. is 2 V/deg. or less, examination was passed. Regarding the memory and the image flow, by visually examining the image, the results were ranked into four stages, i.e. (1) very good, (2) good, (3) no problem in practical use, and (4) there is a problem in practical use.

On the other hand, a-Si films having a thickness of about 1 μm were formed on a glass substrate (7059 manufactured by Corning inc.) and an Si wafer held on a cylindrical sample holder under the photo-conductive layer forming condition. A comb-shaped electrode made of aluminium was deposited on the deposit film on the glass substrate, and the feature energy (Eu) of exponential function tail and local level density (D.O.S) were measured by CPM. Further, the amount of hydrogen in the deposit film formed on the Si wafer was measured by FTIR.

Figure 4:
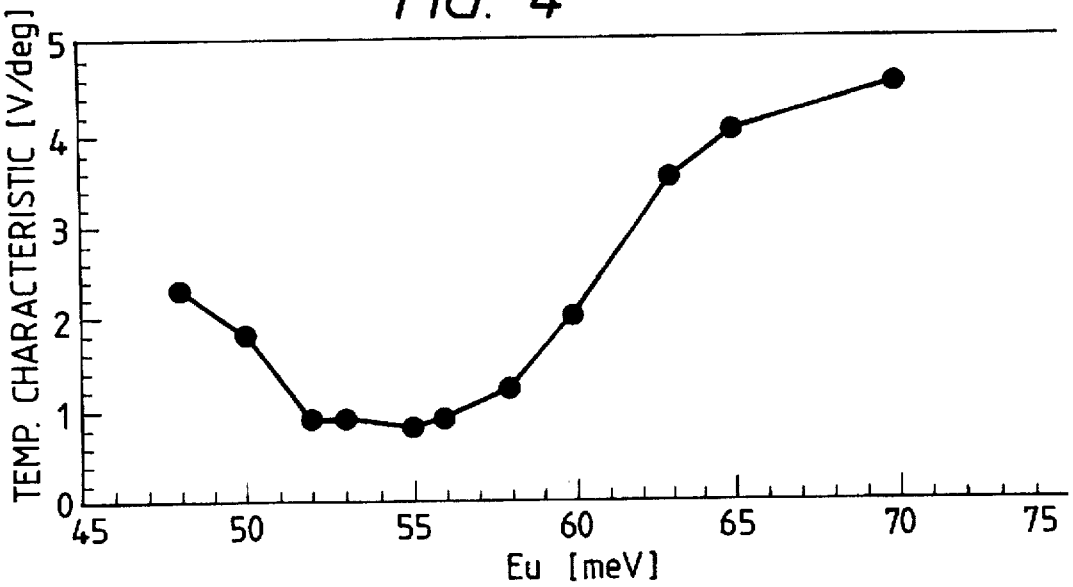
FIG. 4 is a graph showing a relation between feature energy (Eu) of arback tail and a temperature characteristic of a photo-conductive layer of the photosensitive member.
Figure 5:
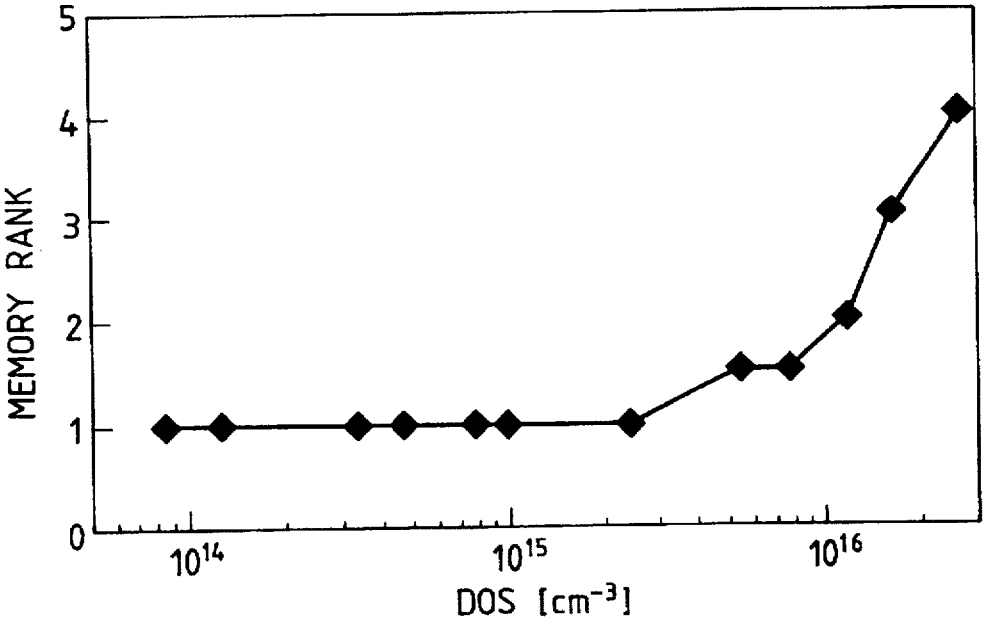
FIG. 5 is a graph showing a relation between local condition density (D.O.S) and optical memory of the photo-conductive layer of the photosensitive member.
Figure 6:
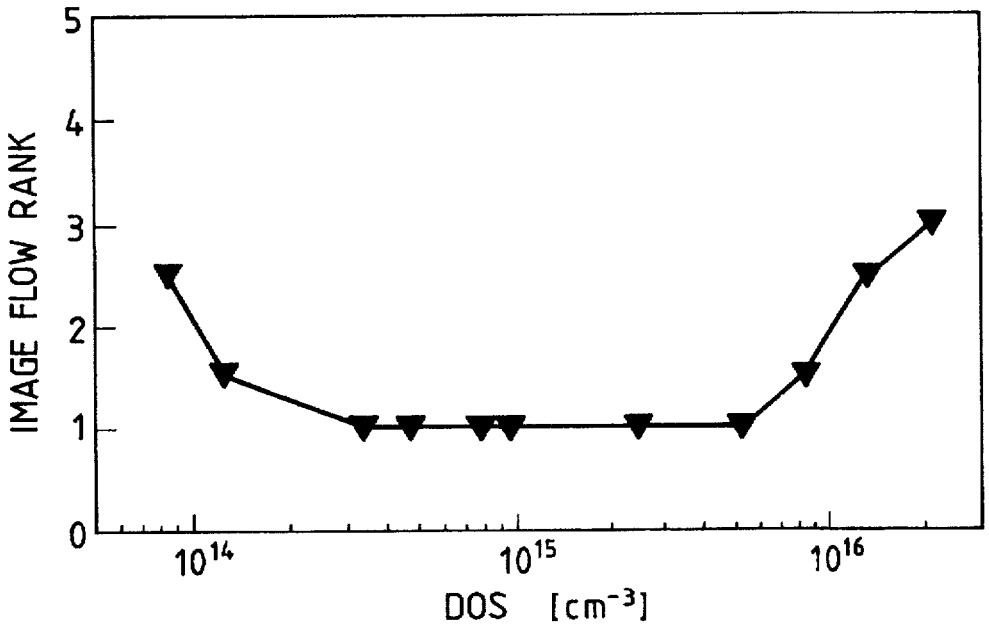
FIG. 6 is a graph showing a relation between local condition density (D.O.S) and image flow of the photo-conductive layer of the photosensitive member.
Figure 7:
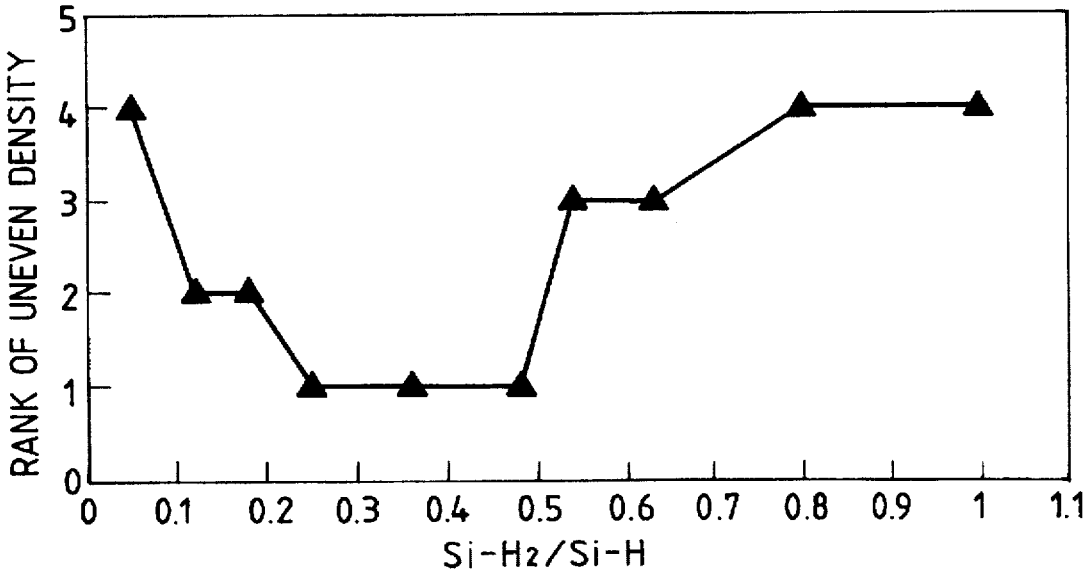
FIG. 7 is a graph showing a relation between an absorption peak intensity ratio between Si—$H_2$ bonding and Si—H bonding, and half tone uneven density.
Figure 8:
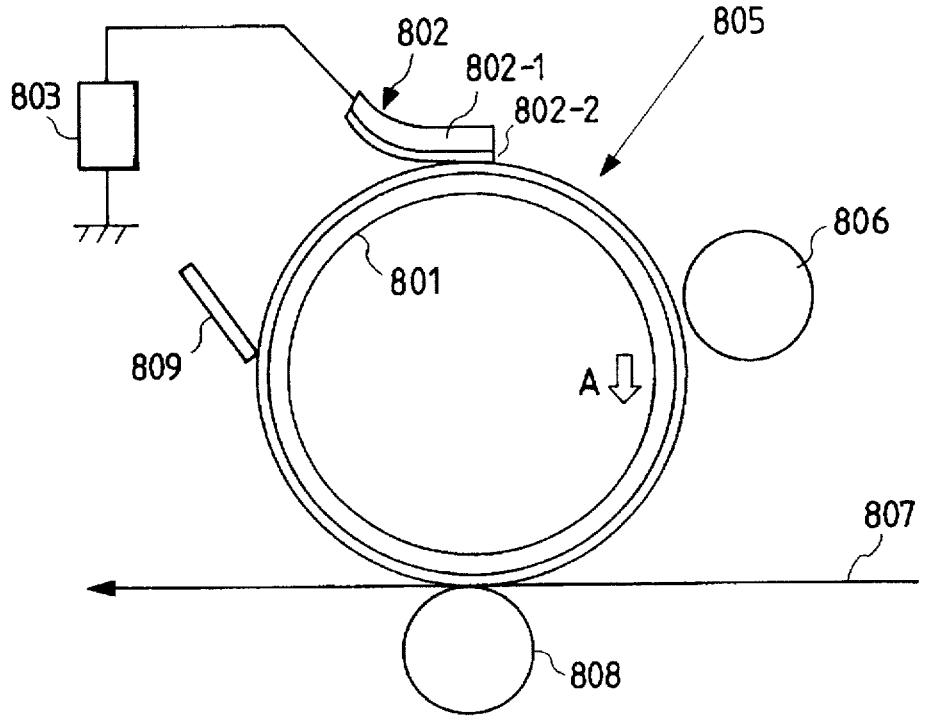
FIG. 8 is a side view of a main portion of a conventional image forming apparatus.

In this regard, a relation between Eu and the temperature characteristic is shown in FIG. 4, and relations between D.O.S and memory/image flow are shown in FIGS. 5 and 6. In every samples, the amount of hydrogen was 10 to 30 atom %. As apparent from these drawings, it was found that Eu=50–60 meV and D.O.S=$1\times10^{14}$ to $1\times10^{16}$ $cm^{-3}$ were required to obtain the good electrophotographic feature. Further, samples of surface layers were similarly formed and resistance values thereof were measured by using the comb-shaped electrodes.

Then, the contact charge members were manufactured in the following conditions.

Regarding the multi pole magnetic member, a plastic magnet was formed in a roll having a diameter of 18 mm in the aforementioned manner. The number of magnetic poles is preferably selected so that a plurality of magnetic poles exist in the charge nip width. In this example, 6 to 18 magnetic poles were provided. And, the magnetic poles arranged in a spiral fashion and the magnetic poles aligned along a longitudinal direction were combined with resin parts, respectively. Regarding the magnet brush layer, the mixture of carriers having a particle diameter of 5 to 35 μm and made of magnetic iron oxide and magnetic powder having a particle diameter of 1 to 5 μm and made of magnesium was used as charge carriers. The charge carriers may have the same components as the conventional carriers used with the toner. The charge nip width was 6 to 7 mm.

Figure 12:
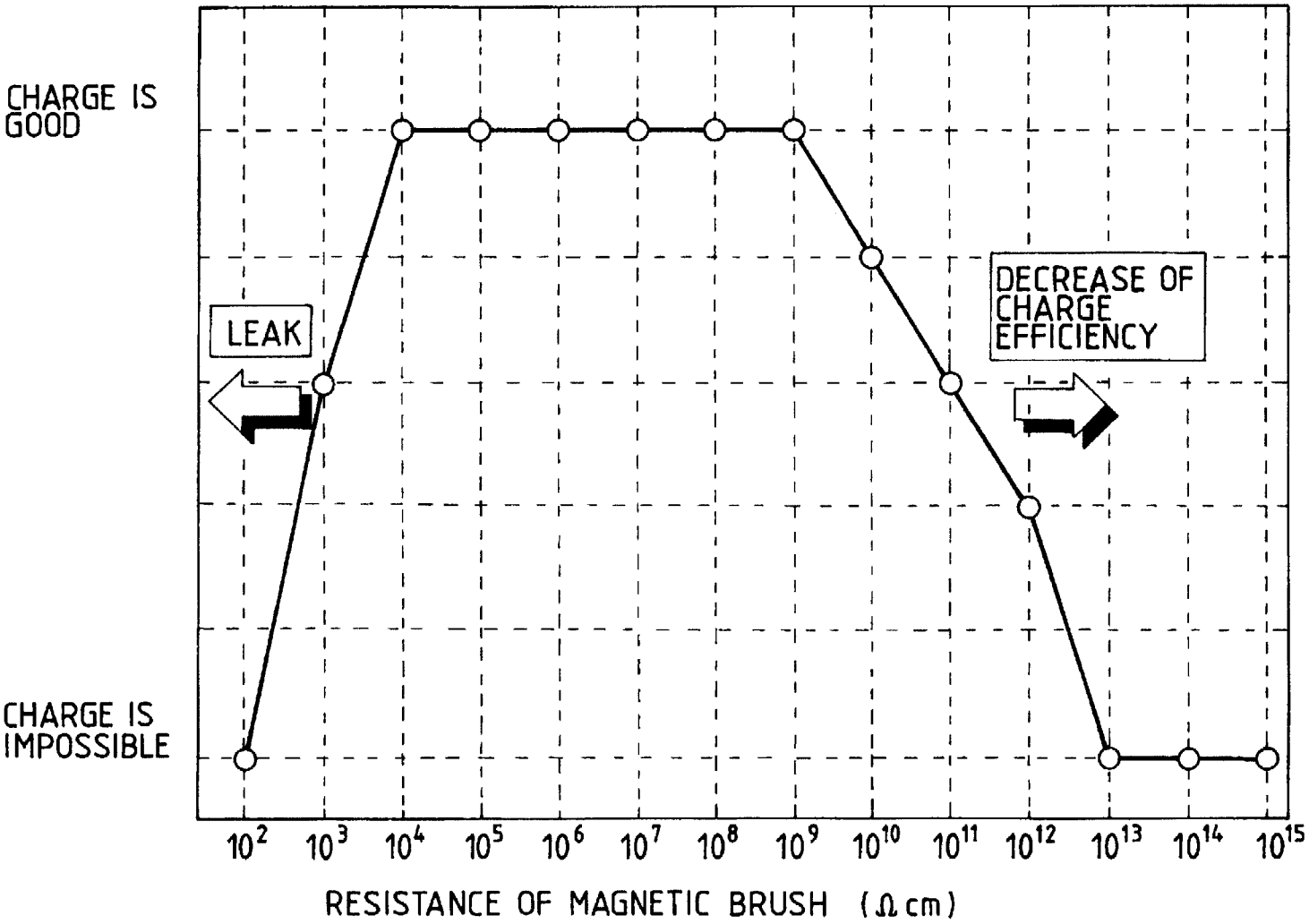
FIG. 12 is a graph showing a relation between resistance and a charged condition of a magnet brush.

The manufactured photosensitive member and contact charge member were mounted to an image forming apparatus shown in FIG. 10, and the charging ability was evaluated. The result is shown in FIG. 12. When the resistance value of the contact charge member ("magnetic brush" in FIG. 12) was $1\times10^3$ to $1\times10^{12}$ Ω.cm, good charging ability was obtained. More preferably, the resistance value was $1\times10^4$ to $1\times10^9$ Ω.cm, good charging ability and good environmental feature regarding image flow could be obtained.

When the resistance value of the contact charge member was smaller than $1\times10^3$ Ω.cm, abnormal discharge and pin hole were generated to damage the photosensitive member. Further, when the resistance value of the contact charge member was greater than $1\times10^{12}$ Ω.cm, the charging ability was decreased, and the charging due to pour-in could not be attained.

Figure 9B:
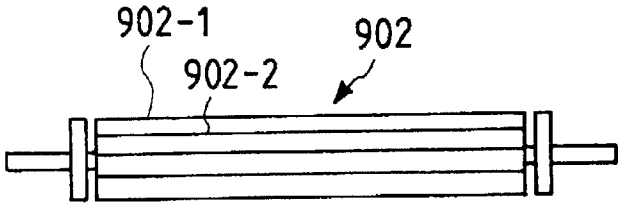
FIG. 9B is a front view of the contact charge member 902.
Figure 9A:
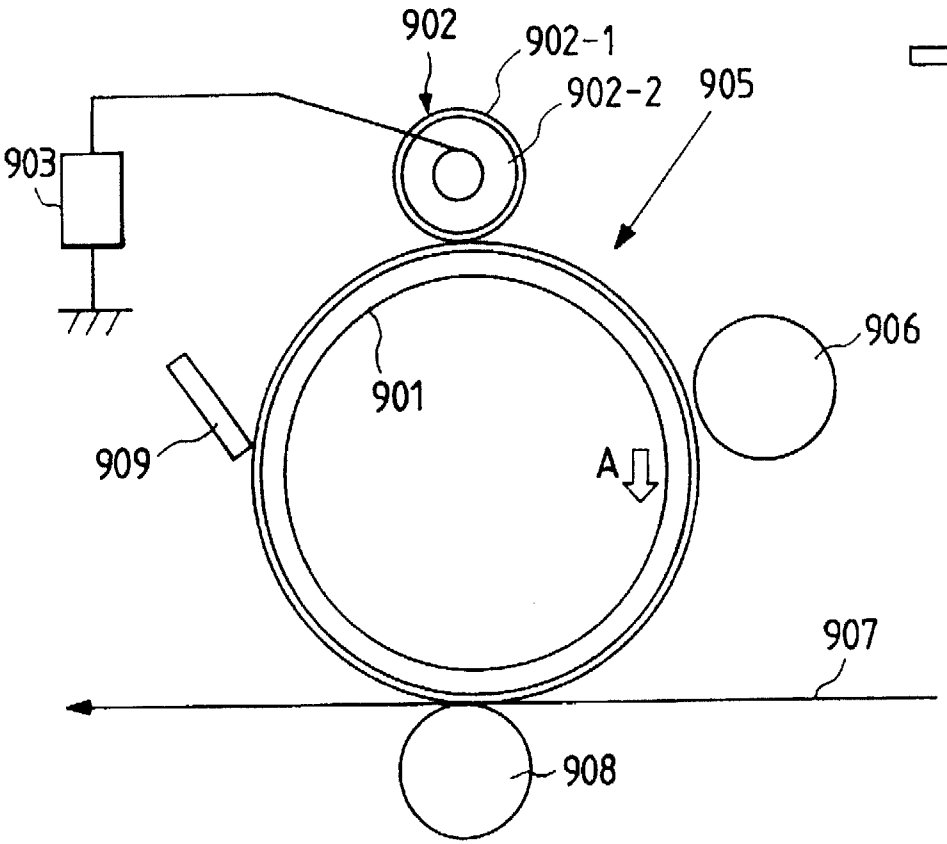
FIG. 9A is a side view of the photosensitive body 901 and contact charge member 902.

As the above-mentioned photosensitive members, six photosensitive members were formed in accordance with conditions (a) to (f) which will be described later, and, as the above-mentioned contact charge members, eight contact charge members were formed in accordance with conditions (A) to (H) which will be described later. Any combination of these members was mounted to the image forming apparatus shown in FIG. 10, and 100,000-sheet pass endurance test was performed under a circumstance (temperature of 23° C., humidity of 60% RH) to compare image qualities before (initial) and after usage. Incidentally, in this example, the contact charge member having magnetic poles aligned along the longitudinal direction is as shown in FIG. 9, and the contact charge member having magnetic poles arranged in the spiral fashion according to the present invention is as shown in FIG. 1B.

The result is shown in FIG. 15.

Voltage of 600 $V_{dc}$ was applied to each contact charge member, and the process speed was 250 mm/sec. Further, in the endurance test, each contact charge member was fixed.

The conditions of the photosensitive members were as follows:

(a) Eu=47 meV, D.O.S=$5\times10^{16}$ $cm^{-3}$,
(b) Eu=50 meV, D.O.S=$2\times10^{14}$ $cm^{-3}$,
(c) Eu=52 meV, D.O.S=$9\times10^{15}$ $cm^{-3}$,
(d) Eu=55 meV, D.O.S=$6\times10^{14}$ $cm^{-3}$,
(e) Eu=58 meV, D.O.S=$3\times10^{16}$ $cm^{-3}$,
(f) Eu=64 meV, D.O.S=$1\times10^{17}$ $cm^{-3}$.

The conditions of the multi pole magnetic members and magnet brush layers of the contact charge members according to the present invention were as follows:

| | | |
|---|---|---|
| (A) $7\times10^2$ Ω · cm | 18 poles | longitudinally aligned poles, |
| (B) $6\times10^7$ Ω · cm | 18 poles | longitudinally aligned poles, |
| (C) $7\times10^2$ Ω · cm | 18 poles | spirally arranged poles, |
| (D) $6\times10^7$ Ω · cm | 18 poles | spirally arranged poles, |
| (E) $5\times10^{10}$ Ω · cm | 18 poles | spirally arranged poles, |
| (F) $3\times10^{13}$ Ω · cm | 18 poles | spirally arranged poles, |
| (G) $6\times10^7$ Ω · cm | 6 poles | spirally arranged poles, |
| (H) $6\times10^7$ Ω · cm | 12 poles | spirally arranged poles. |

From the result shown in FIG. 15, it was found that, when the poles are arranged spirally, the good endurance can be obtained and that, in the spiral arrangement, when the distance between the poles is smaller than the charge nip width, the good endurance can be obtained.

Further, it was found that, when the feature energy of the exponential function tail obtained from the light absorption spectrum of the sub band gap is 50 to 60 meV and the local condition density at 0.45 to 0.95 eV below conductive band end is $1\times10^{14}$ to $5\times10^{16}$ $cm^{-3}$ and when the magnet brush layer has the resistance of $1\times10^3$ to $1\times10^{12}$ Ω.cm, the preferable condition can be obtained. Immediately after the charging was performed by applying voltage of 600 $V_{dc}$, the potential of the dark condition was 550 to 600 V (measured by a surface potentiometer manufactured by TRek Inc.).

<EXAMPLE 2>

Photosensitive members were manufactured by using the manufacturing apparatus shown in FIG. 2 under the manufacturing condition shown in FIG. 16. In this case, Eu and D.O.S of each photo-conductive layer were 55 meV and $2\times10^{15}$ $cm^{-3}$, respectively.

Further, magnet brushes each having a multi pole magnetic member including twelve magnetic poles arranged spirally and a magnet brush layer consisting of carriers and magnetic powder (as is in the example 1) were manufactured as contact charge members. The resistance value was 5×10 Ω.cm. Voltage of 600 $V_{dc}$ was applied to the contact charge member, and the process speed was 250 mm/sec. The contact charge member was rotated in the same direction as the photosensitive member so that a peripheral speed ratio between the contact charge member and the photosensitive member at the contact surface therebetween becomes 150% (Accordingly, the contact charge member is rotated in a direction opposite to the photosensitive member, as shown by the arrows in FIG. 1A). As a result of evaluation similar to the example 1, the good image could be obtained.

It is considered that, even when the distance between the magnetic poles is greater than that in the fixed contact charge member, by rotating the contact charge member, since the adjacent magnetic pole is shifted toward the contact surface (between the contact charge member and the photosensitive member) in the charge nip, the same effect as the small pole-to-pole distance can be obtained.

<EXAMPLE 3>

Figure 13A:
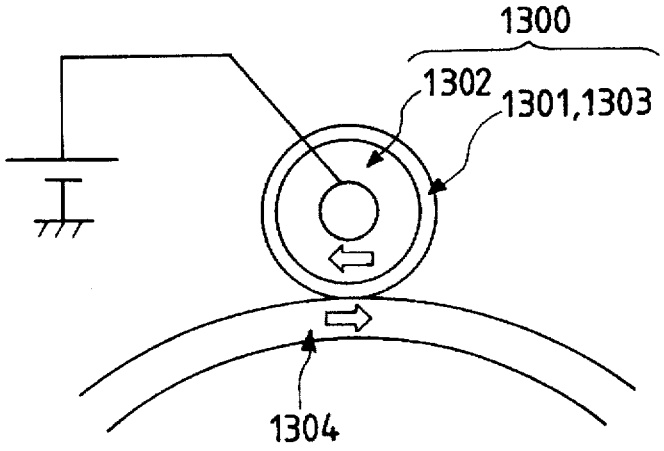
FIG. 13A is a partial side view of a contact charge member and a photosensitive member according to a third embodiment of the present invention.
Figure 13B:
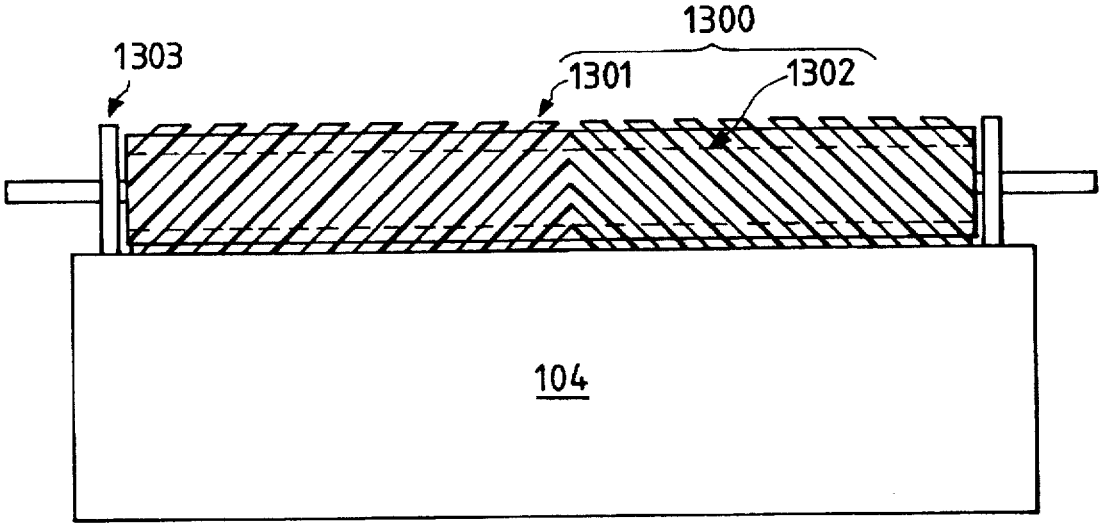
FIG. 13B is a front view of the contact charge member and the photosensitive member of FIG. 13A.

As shown in FIG. 13B, magnetic poles of a multi pole magnetic member 1302 were arranged in two spiral patterns opposite to each other with respect to a longitudinal center of a contact charge member 1300 and projections or ridges having a height of 10 to 100 μm were disposed along the magnetic poles. A magnet brush layer 1301 similar to that of the example 2 was used. The contact charge member 1300 was rotated at a predetermined speed in the same direction as a photosensitive member 1304 (Accordingly, the contact charge member is rotated in a direction opposite to the photosensitive member, as shown by the arrows in FIG. 13A). The resistance of the magnet brush layer 1301 was $3\times10^8$ Ω.cm.

Voltage of 600 $V_{dc}$ was applied to the contact charge member, and the process speed was 250 mm/sec. The photosensitive member 1304 similar to the example 2 was used. As a result of the evaluation similar to the example 1, the good image superior to the example 1 after usage could be obtained.

It is considered that this result can be achieved by the following reason. One of the factors for reducing the charge carriers is loss of charge carriers leaking from the ends of the contact charge member. The ends of the contact charge member are contacted with non-charged portions of the photosensitive member, so that electrostatic forces (due to electric field) for shifting the charge carriers are generated at the ends of the contact charge member. Further, at the ends of the contact charge member, there is no effect for holding and suppressing the charge carriers to prevent the carriers from leaking out of the contact charge member 1300. As a result, the charge carriers are shifted toward the photosensitive member, thereby reducing the amount of the charge carriers.

In the arrangement of this example, as the contact charge member 1300 is rotated, the charge carriers are totally subjected to a force for shifting the charge carriers toward the longitudinal center of the contact charge member 1300 under the action of the projections and upright magnetic powder at the magnetic pole portions, with the result that the reduction of the charge carriers at the ends of the contact charge member can be prevented effectively.

<EXAMPLE 4>

A lower surface layer (intermediate layer) having a thickness of 1 μm was formed by coating 5% methanol solution of alkoxy-methyl nylon on an aluminium cylinder substrate (support) having an outer diameter of 80 mm and a length of 358 mm by an impregnating method.

Then, titanyl-phthalocyanine pigment of 10 weight parts, polyvinyl butylal of 8 weight parts and cyclohexanone of 50 weight parts were mixed and dispersed in a sandmill device using glass beads (having a diameter of 1 mm) of 100 weight parts for 20 hours. A mixture obtained by adding methyl-ethyl ketone of 70 to 120 weight parts to the dispersed solution was coated on the lower surface layer, and the structure was dried at a temperature of 100° C. for five minutes to form a charge generating layer having a thickness of 0.2 μm.

Then, styryl compound (having formula shown in FIG. 17) of 10 weight parts and bisphenol-Z-polycarbonate of 10 weight parts were dissolved in monchlorobenzene of 65 weight parts. The solution obtained in this way was coated on the charge generating layer, and the structure was dried by hot blow of 120° C. for 60 minutes to form a charge transferring layer having a thickness of 20 μm.

Then, a surface layer having a thickness of 1.0 μm was formed on the charge transferring layer in the following manner.

High melting point polyethylene terephthalate (A) obtained by terephthalic acid (acid component) and ethylene glycol (glycol component) of 100 weight parts [limiting viscosity of 0.70 dl/g; melting point of 258° C. (measured by using a differential heat measuring device at a temperature increase speed of 10° C./min. A measuring sample of 5 mg was obtained by melting polyester resin to be measured at a temperature of 280° C. and then by quickly cooling the resin by icy water of 0° C.); glass transition temperature of 70° C.], and epoxy resin (B) of 30 weight parts [epoxy equivalent of 160; aromatic ester type; commercial name: Epicoat (manufactured by Yuka Shell Epoxy inc.)] were dissolved in a mixed solution of 100 ml (including phenol and tetrachloroethane at 1:1). Further, $SnO_2$ powder (as charge holding particles) of 60 weight % was mixed with the solution. Then, triphenyl-sulphonium-hexanefluoroantimonate (C) of 3 weight parts (as photopolymerization agent) was added to thereby adjust resin composition dissolution.

Regarding the light illumination condition, the resin was cured by illuminating a 2 kW high pressure mercury lamp (30 W/cm) for 8 seconds at 130° C. from a position spaced apart from the resin by 20 cm.

Figures 17, 18:
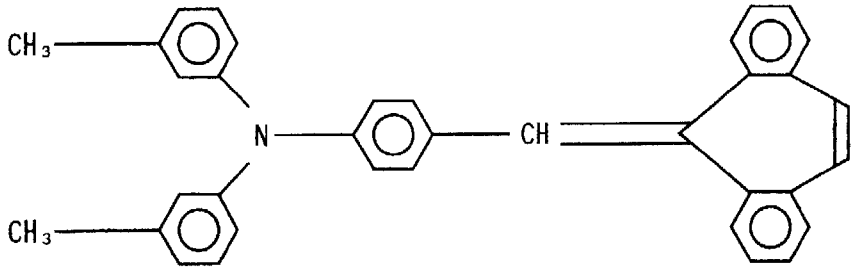
FIG. 17 is a view showing structural formula of stylic compound forming a charge transferring layer according to a fourth embodiment of the present invention.
FIG. 18 is a view showing relations between combination of the photosensitive member/charge contact charge member of the first embodiment and image quality before (initial) and after usage, in fourth and fifth embodiments of the present invention and a comparison example 1.

The photosensitive member manufactured in this way was mounted to the image forming apparatus shown in FIG. 10, and the above-mentioned contact charge members (A) to (H) were used. In this condition, under a circumstance (temperature of 30° C., humidity of 80 % RH), 100,000-sheet pass endurance test was performed to evaluate high humidity image flow and uneven stripes. Voltage of 700 $V_{dc}$ was applied to the contact charge member, and the process speed was 200 mm/sec. The charge potential measured immediately after the charging was 650 V or more. The result of evaluation is shown in FIG. 18.

<EXAMPLE 5>

In place of the protection layer of the example 4, the following protection layer was formed. As binder same as that used in the charge transferring layer, $SnO_2$ powder of 60 weight % was mixed with acrylic resin, and this mixture was coated on the layer to have a film thickness of 1.0 μm to form a surface layer of the photosensitive member. The endurance test similar to the example 4 was performed. The result is shown in FIG. 18.

<Comparison Example 1>

A photosensitive member similar to the example 5 other than the protection layer of the photosensitive member in the example 4 was manufactured. And, the endurance test similar to the example 4 was performed. The result is shown in FIG. 18. From FIG. 18, it was found that the good result can be obtained by providing the surface layer including high melting point polyester resin and curable resin and having $SnO_2$ charge holding particles dispersed therein or the surface layer having $SnO_2$ charge holding particles dispersed in acrylic resin.

<EXAMPLE 6>

A photosensitive member consisting of a charge pour-in preventing layer, a photo-conductive layer and a surface layer was formed on a mirror-finished aluminium cylinder (support) having a diameter of 108 mm by using the manufacturing apparatus: for manufacturing the photosensitive member utilizing the VHF-PCVD method (FIG. 3) under the conditions shown in FIG. 19.

Further, by changing the mixing ratio between $SiH_4$ and $H_2$ of the photo-conductive layer and the discharge electric power, various photosensitive members were manufactured. The manufactured photosensitive members were mounted on an image forming apparatus (test apparatus modified from NP 6060 of Canon Inc.), respectively, and temperature dependency of charging ability (temperature characteristic), blank memory and ghost memory were evaluated. The evaluation of the temperature characteristic and memory was the same as the example 1. Further, as is in the memory, the results of the uneven density of half tone images were ranked into four stages and were evaluated.

On the other hand, a-Si films having a thickness of about 1 μm were formed on a glass substrate (7059 manufactured by Corning Inc.) and an Si wafer held on a cylindrical sample holder under the photo-conductive layer forming condition. A comb-shaped electrode made of aluminium was deposited on the deposit film on the glass substrate, and the feature energy (Eu) of exponential function tail and local level density (D.O.S) were measured by CPM. Further, regarding the deposit film formed on the Si wafer, the amount of hydrogen and absorption peak intensity ratio between Si—$H_2$ bond and Si—H bond were measured by FTIR. A relation between Eu and the temperature characteristic and relations between D.O.S and memory/image flow were the same as the example 1, and it was found that Eu=50–60 meV and D.O.S=$1\times10^{14}$ to $1\times10^{15}$ $cm^{-3}$ were required to obtain the good electrophotographic feature. Further, from a relation between the uneven density and Si—$H_2$/Si—H, it was found that Si—$H_2$/Si—H=0.2 to 0.5 must be satisfied.

Among the above photosensitive members, regarding photosensitive members having Eu of 54 meV, D.O.S of $8\times10^{14}$ $cm^{-3}$ and Si—$H_2$/Si—H of 0.29, the evaluation similar to the example 2 was effected. The good result could be obtained.

<EXAMPLE 7>

Figure 3:
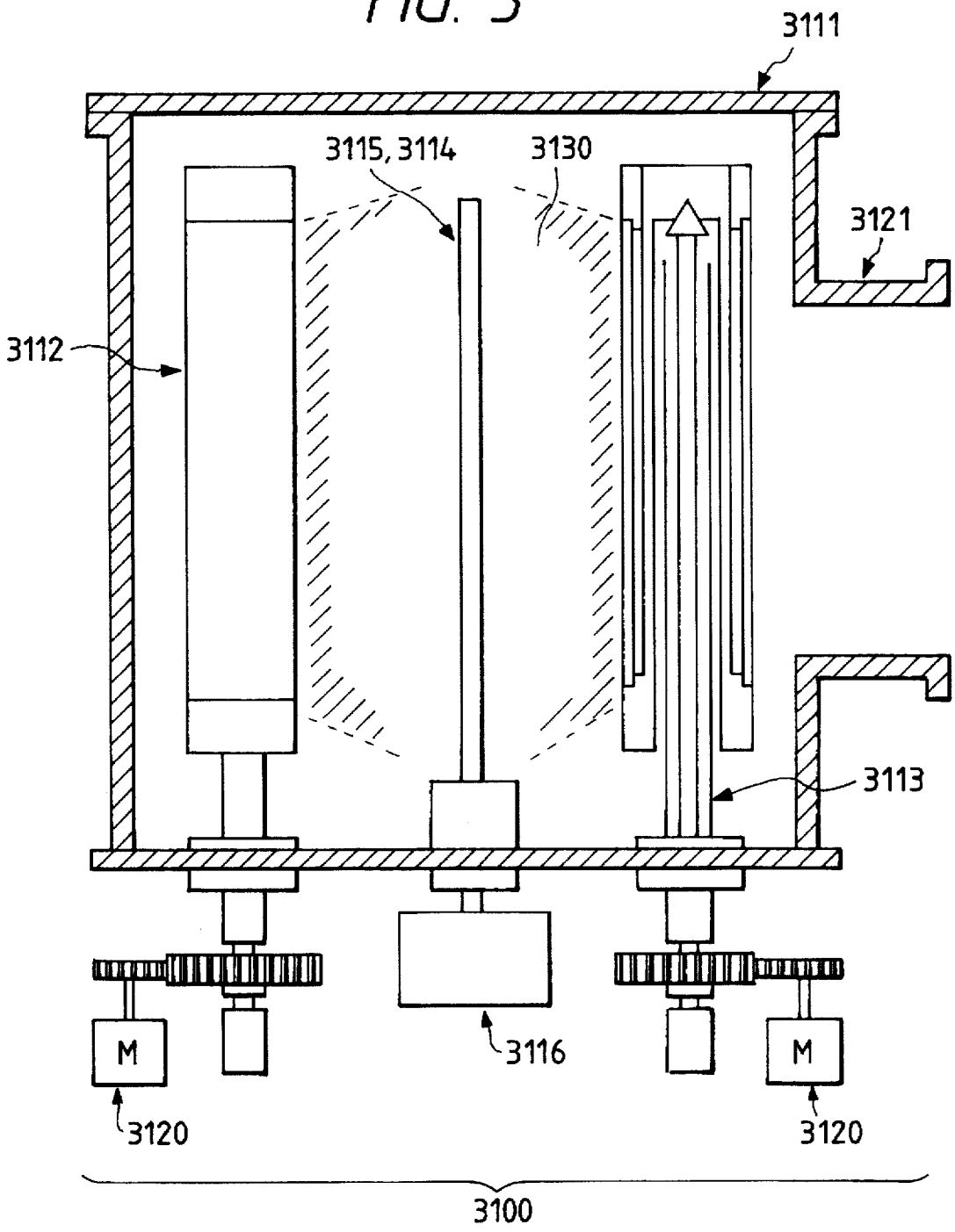
FIG. 3 is a schematic illustration showing an apparatus for manufacturing a photosensitive member of an image forming apparatus by a flow discharge method using high-frequency wave having VHF band as an example of an apparatus for forming a light receiving layer of the photosensitive member.

A photosensitive member is manufactured by using the manufacturing apparatus for manufacturing the photosensitive member shown in FIG. 3 under the conditions shown in FIG. 20. In this case, Eu, D.O.S and Si—$H_2$/Si—H of a photo-conductive layer were 53 meV, $5\times10^{14}$ $cm^{-3}$ and 0.29, respectively. As a result that the manufactured photosensitive member was evaluated by using the contact charge member in the same manner as the example 6, the good feature similar to the example 6 could be obtained.

<EXAMPLE 8>

A photosensitive member is manufactured by using the manufacturing apparatus for manufacturing the photosensitive member shown in FIG. 3 under the condition shown in FIG. 21. In this case, Eu, D.O.S and Si—$H_2$/Si—H of a photo-conductive layer were 56 meV, $1.3\times10^{15}$ $cm^{-3}$ and 0.38, respectively. As a result that the manufactured photosensitive member was evaluated by using the contact charge member in the same manner as the example 6, the good electrophotographic feature similar to the example 6 could be obtained.

<EXAMPLE 9>

A photosensitive member is manufactured by using the manufacturing apparatus for manufacturing the photosensitive member shown in FIG. 3 under the conditions shown in FIG. 22. In this case, Eu, D.O.S and Si—$H_2$/Si—H of a photo-conductive layer were 59 meV, $3\times10^{5}$ $cm^{-3}$ and 0.45, respectively. As a result that the manufactured photosensitive member was evaluated by using the contact charge member in the same manner as the example 4, the good electrophotographic feature similar to the example 4 could be obtained.

Incidentally, in the above-mentioned examples 1 to 9, in place of the DC voltage ($V_{dc}$), even when AC voltage+DC voltage ($V_{ac}+V_{dc}$) were applied to the contact charge member, the same results could be obtained.

What is claimed is:

1. A charge apparatus comprising:

a charge member to which a voltage is applied for charging a member to be charged;

wherein said charge member has a bearing member for bearing a magnetic particle layer contacted with said member to be charged, said bearing member includes therein a plurality of magnetic poles disposed in a circumferential direction thereof and said magnetic poles are arranged in a spiral fashion, and wherein a distance between two adjacent magnetic poles in the circumferential direction of said bearing member is smaller than a contact width between said magnetic particle layer and said member to be charged in the circumferential direction of said bearing member.

2. A charge apparatus according to claim 1, wherein said bearing member is made of a magnetic body.

3. A charge apparatus according to claim 2, wherein said bearing member is rotatable.

4. A charge apparatus according to claim 1, further comprising a convey means for conveying the magnetic particles from longitudinal ends toward a central portion of said bearing member in a longitudinal direction thereof.

5. An image forming apparatus comprising:

an image bearing member for bearing an image and including a surface layer having volume resistivity of $1\times10^{10}$ to $5\times10^{15}$ [$5\times10^{5}$]Ω.cm; and a charge member to which voltage is applied for charging said image bearing member, said charge member having a bearing member for bearing a magnetic particular layer contacted with said image bearing member, said bearing member including therein a plurality of magnetic poles disposed in a circumferential direction thereof, and said magnetic poles being arranged in a spiral fashion, wherein a distance between two adjacent magnetic poles in the circumferential direction of said bearing member is smaller than a contact width between said magnetic particle layer and said image being member in the circumferential direction of said bearing member.

6. An image forming apparatus according to claim 5, wherein said image bearing member comprises a conductive support, a photo-conductive layer having a photo-conductive feature and formed from non single crystal material based on silicon atoms and including at least one of hydrogen atoms and halogen atoms, and a light receiving layer including a surface layer having a charge holding function, wherein said photo-conductive layer includes hydrogen atoms of 10 to 30 atom % and having feature energy of exponential function tail of 50 to 60 meV obtained from light absorption spectrum of sub band gap at least a portion on which light is incident, and local condition density of $1\times10^{14}$ to $1\times10^{16}$ $cm^{-3}$.

7. An image forming apparatus according to claim 5, wherein said bearing member is formed from a magnetic body.

8. An image forming apparatus according to claim 7, wherein said bearing member is rotatable.

9. An image forming apparatus according to claim 5, further comprising a convey means for conveying magnetic particles from ends toward a central portion of said bearing member in a longitudinal direction thereof.

* * * * *

UNITED STATES PATENT AND TRADEMARK OFFICE

CERTIFICATE OF CORRECTION

PATENT NO. : 5,732,313

DATED : March 24, 1998

INVENTORS : Masaya Kawada, et al.

It is certified that error appears in the above-identified patent and that said Letters Patent is hereby corrected as shown below:

COLUMN 9

Line 41, "forge" should read --force--;
Line 42, "forge" should read --force--; and
Line 53, "forge" should read --force--;

COLUMN 12

Line 2, "S-Si" should read --Si-Si--.

COLUMN 20

Line 10, "room-temperature" should read --room temperature--.

COLUMN 24

Line 64, "incidentally," should read --Incidentally,--.

UNITED STATES PATENT AND TRADEMARK OFFICE

CERTIFICATE OF CORRECTION

PATENT NO. : 5,732,313

DATED : March 24, 1998

INVENTORS : Masaya Kawada, et al.

It is certified that error appears in the above-identified patent and that said Letters Patent is hereby corrected as shown below:

COLUMN 34

Line 22, "[$5 \times 10^5$]" should be deleted.

Signed and Sealed this

Fifteenth Day of December, 1998

Bruce Lehman

*Attest:*

BRUCE LEHMAN

*Attesting Officer*

*Commissioner of Patents and Trademarks*